United States Patent [19]

Kobayashi et al.

[11] 4,262,352

[45] Apr. 14, 1981

[54] ELECTRONIC MULTIFUNCTION TIMEPIECE EMPLOYING THE PLA SYSTEM

[75] Inventors: Isamu Kobayashi, Hinode; Takashi Ito, Musashino, both of Japan

[73] Assignee: Hitachi, Ltd., Tokyo, Japan

[21] Appl. No.: 13,067

[22] Filed: Feb. 21, 1979

[30] Foreign Application Priority Data

Feb. 17, 1978 [JP] Japan ..... 53-16485

[51] Int. Cl.[3] ..... G04C 19/00; G04C 15/00

[52] U.S. Cl. ..... 368/82; 368/155

[58] Field of Search ..... 58/23 R, 38 R, 38 A, 58/39.5, 50 R, 50 A, 74, 152; 364/705; 368/28-30, 72, 73, 89, 109

[56] References Cited

U.S. PATENT DOCUMENTS

| | | | |
|---|---|---|---|
| 4,063,409 | 12/1977 | Bayliss | 58/4 A |
| 4,093,992 | 6/1978 | Kawamura et al. | 364/705 |
| 4,158,285 | 6/1979 | Heinsen et al. | 368/29 |

FOREIGN PATENT DOCUMENTS

| | | | |
|---|---|---|---|
| 2548511 | 5/1976 | Fed. Rep. of Germany | 368/155 |
| 2816820 | 11/1978 | Fed. Rep. of Germany | 368/155 |
| 13189/73 | 6/1976 | Switzerland | 368/155 |

*Primary Examiner*—Vit W. Miska

*Attorney, Agent, or Firm*—Craig & Antonelli

[57] ABSTRACT

Disclosed is an electronic multifunction timepiece employing the PLA system, including a key input circuit, a clock pulse generator circuit, a random access memory which stores time data therein, an adder circuit, and a read only memory which stores therein control instructions for controlling operations of said random access memory and said adder circuit and for causing said random access memory to write renewed time data and which provides the control signals sequentially on the basis of clock pulses of said clock pulse generator circuit, characterized in that said read only memory comprises a first read only memory which stores therein control signals for renewing the time data of said random access memory independently or operation modes appointed by said key input circuit, and a second read only memory which stores therein control instructions for controlling information processing operations in the operation modes appointed from said key input circuit.

12 Claims, 18 Drawing Figures

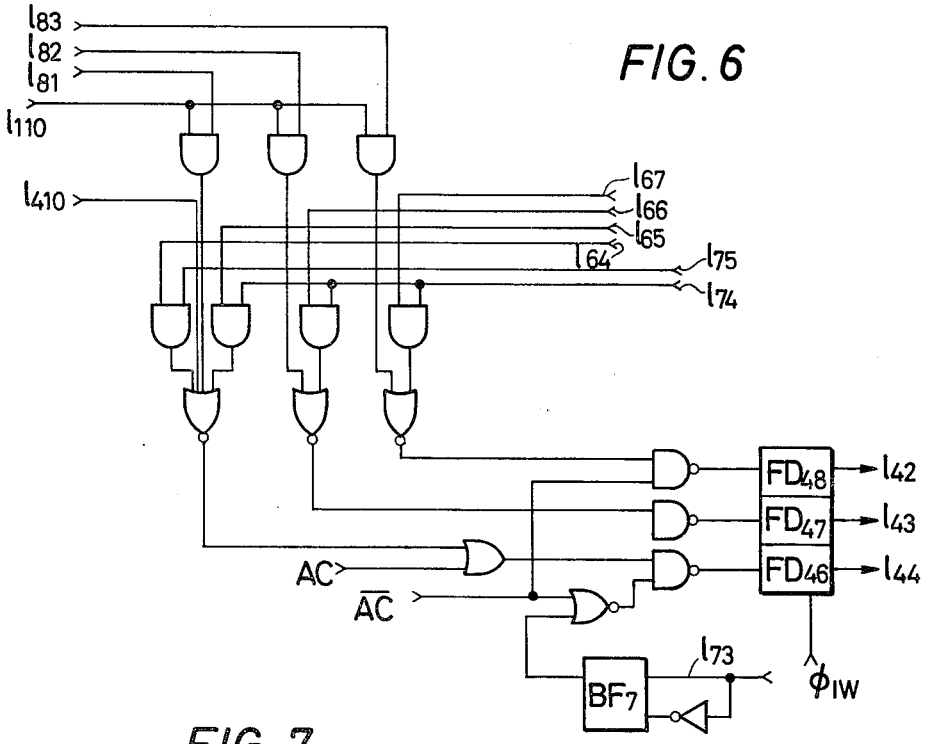
FIG. 6
FIG. 7
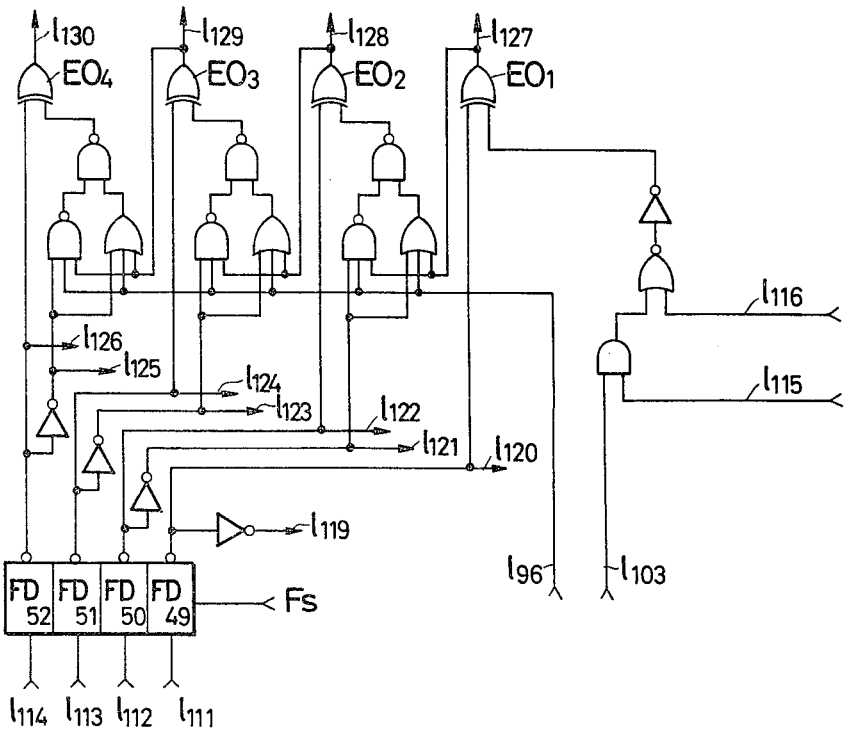

282
281
279
277
274
273
271
269
267
DFR 6
DFR 7
DFR 8
DFR 9
DFR 10
DFR 11
DFR 12
DFR 13
DFR 14
DFR 15
DFR 16
DFR 17
177
175
173
171
169
167
165
163
161
159
157
147
E
AC
Fs
φIW>

ELECTRONIC MULTIFUNCTION TIMEPIECE EMPLOYING THE PLA SYSTEM

BACKGROUND OF THE INVENTION

This invention relates to the PLA (programmable logic array) system of an electronic multifunction timepiece. More particularly, it is directed to an electronic multifunction timepiece which is constructed into a semiconductor integrated circuit.

In electronic timepieces, a plurality of functions such as a stop watch function and a timer function have become necessary in addition to operational functions for a time display conforming with the standard time.

In order to obtain such a timepiece having a plurality of functions, exclusive circuits for executing the respective functions may be disposed and combined. With the combination of the exclusive circuits, however, when the number of desired functions increases, the whole circuit arrangement becomes complicated, and the number of elements to be used increases.

On the other hand, a dynamic logic system may be adopted. In the dynamic logic system, data processings for realizing the plurality of functions are sequentially carried out in such a way that control instructions written in a ROM (read only memory) are sequentially read out at predetermined timings. According to the dynamic logic system, it is possible to use the memory, an arithmetic circuit, etc. in common for the respective functions. As a result, the complication of the circuit arrangement and the increase of the number of elements to be used are preventable.

However, in e.g. a timepiece of the dynamic logic system with the stop watch function whose time base is 0.01 second, various data processings are carried out within the time of 0.01 second. Therefore, as the number of the functions increases, the quantity of the data processings to be executed within the predetermined time increases. In order to increase the quantity of the data processings within the predetermined time, the frequency of timing pulses must be made high.

Stray capacitances and other capacitances in the circuit are charged and discharged by changes in the signals of the circuit. Power is dissipated by the charging and discharging of the capacitances. In consequence, the power dissipation of the circuit increases due to the raised frequency of the timing pulses.

In case of adding or altering the clock function, the display system etc., the allotment of the periods of time for the various data processings and the like need to be renewed. This leads to the problem that the electronic timepiece lacks in versatility.

SUMMARY OF THE INVENTION

It is accordingly an object of this invention to provide an electronic multifunction timepiece of low power dissipation.

Another object of this invention is to provide an electronic multifunction timepiece of high versatility.

Another object of this invention is to provide an electronic multifunction timepiece adopting the PLA system which renders the power dissipation low and which has a high versatility.

Another object of this invention is to provide an electronic multifunction timepiece which has a small number of circuit elements used.

The multifunction electronic timepiece of the dynamic logic system according to this invention uses the two kinds of ROMS; a main ROM and a control ROM in order to control the operations of the timepiece.

In the main ROM, there are written control instructions for the arithmetic processings of time data such as second, minute, hour and date. In the control ROM, there are written control instructions for the controls of the internal modes of the timepiece such as key input, time correction, alarm and display.

In accordance with the improvements of this invention, the ROM is of the page construction. A plurality of control instructions which are distinguished by the status information of the clock or display operation and key input information are written into the ROM at an identical readout step.

The above-mentioned and further objects, features and advantages of this invention will be understood from the following description taken with reference to the drawings.

BRIEF DESCRIPTION OF THE DRAWINGS

FIG. 3A is a symbol diagram of a ROM, while

FIG. 6 is a detailed logical circuit diagram showing a latching circuit and a page control circuit (blocks 4 and 5) in FIG. 1.

FIG. 7 is a detailed logical circuit diagram of an adder and subtractor (block 7) in FIG. 1.

FIGS. 11 to 14 are detailed logical circuit diagrams of a control ROM (block 13) in FIG. 1, among which FIG. 11 shows a part a of the block 13, FIG. 12 shows a part b and FIGS. 13 and 14 show a part c.

DESCRIPTION OF THE PREFERRED EMBODIMENT

Hereunder, this invention will be concretely described in connection with an embodiment.

Figure 1:
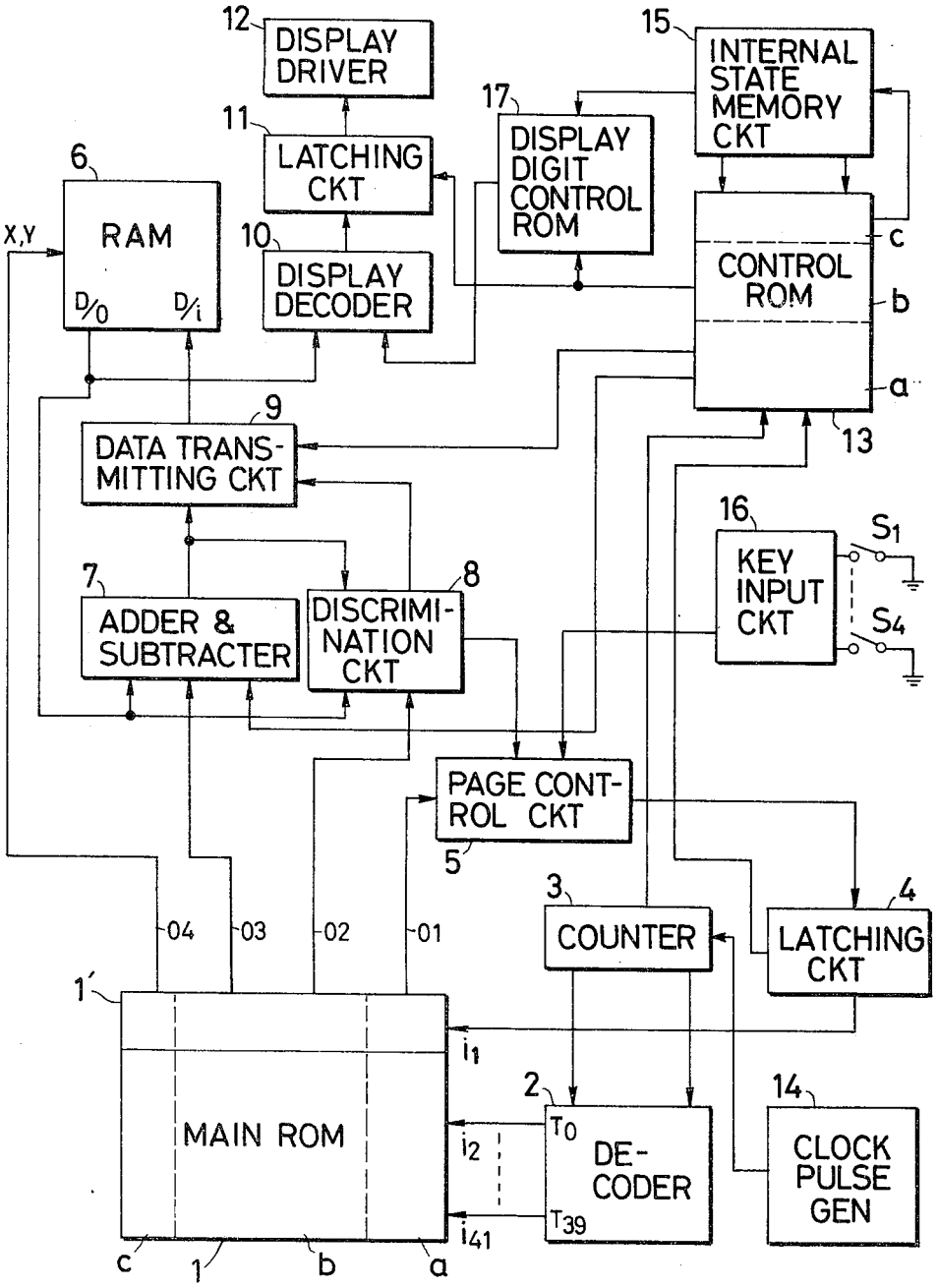
FIG. 1 is a block diagram of an electronic multifunction timepiece according to an embodiment of this invention.

FIG. 1 is a block diagram showing an embodiment of this invention.

Numeral 1 designates a main ROM in which control instructions are written. An output from a latching circuit 4 to be described later is applied to an input line group $i_1$ of the main ROM 1, while an output from a decoder circuit 2 is applied to input lines $i_2$ to $i_{41}$. In the main ROM 1, a plurality of instruction codes are written in addresses assigned by the decoder circuit 2. The instruction codes within the addresses assigned by the decoder circuit 2 are selected by the output of the latching circuit 4. In the ROM 1, a part 1' which is laterally defined forms a column select. The main ROM 1 is a ROM of the page assignment system which receives the output of the latching circuit 4 as a page assigning instruction.

A column area a of the main ROM 1 stores therein an instruction which assigns the next page of the ROM 1. An output line group $O_1$ of the column area a is connected to an input of a page control circuit 5 to be described later. A column area b stores therein processing instructions which include addition and subtraction instructions (+1, −1 instructions), an addend or subtrahend "1", comparative data of a discrimination circuit 8, data after the clear of a data transmitting circuit 9, etc. One output line group $O_2$ of the column area b is connected to an input of the discrimination circuit 8, while the other output line group $O_3$ is connected to an adder and subtracter circuit 7. A column area c stores address data therein, and its output line group $O_4$ is connected to an address input of a RAM (random access memory) 6.

Shown at 3 is a counter. Although not specifically restricted, it is composed of binary counters of 6 bits connected in series in case of this embodiment. The counter 3 is constructed as a divide-by-40 counter. The counter 3 counts 4,000 pulses per second which are formed by a clock pulse generator 14. In consequence, a state "40" which the 6 bits of the output of the counter indicate is repeated 100 times in 1 second. That is, 1 cycle of the counter is 1/100 second.

The decoder circuit 2 receives the output of the counter 3, and sequentially generates output pulses at output terminals $T_0$ to $T_{39}$ in correspondence with the states of the counter 3. Each of the outputs of $T_0$ to $T_{39}$ of the decoder circuit 2 assigns the address of the main ROM 1. Since the sequential pulses which are delivered to the 40 output terminals $T_0$ to $T_{39}$ of the decoder circuit 2 are repeated every 1/100 second, the main ROM 1 provides 40 steps of control instructions in 1/100 second.

The RAM 6 writes data delivered from the data transmitting circuit 9, into the address appointed by the output line group 4 of the main ROM 1. It also supplies data having been stored in the address, to the adder and subtractor 7 and the discriminator circuit 8.

The RAM 6 has, for example, eight X addresses and six Y addresses. Data as indicated in Table 1 are written in the respective addresses which are assigned by the X addresses $X_0$–$X_7$ and the Y addresses $Y_0$–$Y_5$.

Table 1

| | $X_0$ | $X_1$ | $X_2$ | $X_3$ | $X_4$ | $X_5$ | $X_6$ | $X_7$ |
|---|---|---|---|---|---|---|---|---|
| $Y_0$ | $D_0$ | $CA_1$ | | $CA_3$ | 1 D | 10 D | 1 M | Week |
| $Y_1$ | $\frac{1}{100}$ s | $\frac{1}{10}$ s | 1 s | 10 s | 1 m | 10 m | 1 H | AM/PM |
| $Y_2$ | $\frac{1}{100}$ s | $\frac{1}{10}$ s | 1 s | 10 s | 1 m | 10 m | 1 H | |
| $Y_3$ | | | | | | | | |
| $Y_4$ | 1 m | 10 m | 1 H | AM/PM | | | | |
| $Y_5$ | | | $\frac{1}{100}$ SON | $\frac{1}{100}$ SOFF | | | | Label |

$D_0$; page control data for a carry processing
$CA_1$; carry to 1-second data
$CA_3$; carry to 1-minute data
D; day data
M; month data
Week; week data
s; second data
m; minute data
H; hour data
SON; key chattering avoiding data
SOFF; key bounce avoiding data The latching circuit 4 stores therein a page under operation. This page output is used as a column select signal for the main ROM 1.

The data within the address of the RAM 6 appointed by the output line group $O_4$ of the main ROM 1 is altered by an output of the data transmitting circuit 9 which is controlled by the output line groups $O_2$ and $O_3$ of the main ROM 1.

In this case, 1 cycle of the decoder circuit 2 is made 1/100 second as stated previously. Therefore, the 1/100 second-data etc. of the RAM 6 has 1 (one) infallibly added thereto at an identical timing in one circulation of the addresses of the main ROM 1 assigned by the timings $T_0$–$T_{39}$. Although this is not especially restrictive but is merely illustrative, 1 (one) is added to the 1/100 second-data at the timing $T_{10}$. The page of the main ROM 1 for the addition is made, for example, page 0 (zero).

Accordingly, the main ROM 1 cannot assign any other page than page 0 at the timing $T_{10}$ for counting the 1/100 second. On the other hand, data later in time, for example, data of 1 second has 1 (one) added thereto for the first time when the timing signals $T_0$–$T_{39}$ have effected 100 circulations. Therefore, a carry from the 1/10 second-data is written in the RAM 6 as data, whereby the addition need not be done immediately after the carry. That is, when that timing other than the timing for counting the 1/100 second at which a plurality of pages can be assigned has been reached, the RAM 6 may be accessed to discriminate the carry data and to add 1 (one) to the 1 second-data. This processing can also be done after any number of circulations of the 1/100 second-timing in such a way that data which is appropriately counted is used as the data to be written into the RAM 6. In this manner, the detections of coincidence of data later in time or data of an alarm may be suitably controlled and processed at any number of circulations without being processed every circulation of the addresses $T_0$–$T_{39}$.

On the basis of the data of the next page assigned by the main ROM 1 and the output of the discriminator circuit 8, the page control circuit 5 selects data of the next page for selecting an instruction word to be subsequently executed and delivers the data to the latching circuit 4.

Although not especially restricted, a key input ROM 16 in this embodiment is constructed so as to provide a key code signal having the same number of bits as that of page control data in correspondence with an actuated one of key switches $S_1$ to $S_4$. The key code signal is applied to the page control circuit 5. Among the timings $T_0$ to $T_{39}$ of the decoder circuit 2, a specified timing, for example, $T_{27}$ is allotted to the load of the key code signal. At the timing $T_{27}$, the key code signal is stored into the latching circuit 4 through the page control circuit 5. This key code signal in the latching circuit 4 at the timing $T_{27}$ is supplied to a control ROM 13 to be described later.

Besides the key code signal at the timing $T_{27}$ is stated above, three sorts of page control data to be explained hereunder are stored into the latching circuit 4.

(1) The data of the next page in the column area a of the ROM 1 is unconditionally stored into the latching circuit 4.

(2) Only when the data of an operated result and the comparative data provided from the column area b of the main ROM 1 coincide in the discrimination circuit 8, the data of the next page in the column area a of the main ROM 1 is stored into the latching circuit 4. At this time, when both the data are not coincident, page zero is stored into the latching circuit 4.

(3) When both the data referred to in (2) coincide, the lowermost 1 bit of the next page becomes "1" (+1 page). When they do not coincide, the lowermost bit becomes "0". As to the upper bits, the data of the next page in the area a of the ROM 1 are unconditionally stored into the latching circuit 4.

A clock operation is executed at a certain address of the main ROM and by an instruction word of a certain page. For example, a renewed time data can be obtained from the adder and subtractor 7 in such a way that the data of the output of the RAM 6 is supplied to the adder and subtracter 7 and that an addition or subtraction instruction (+1 or −1 instruction) provided from the area b of the ROM 1 is applied to the adder and subtracter 7. In order to clear the data, the exchange of data is carried out through the discriminator circuit 8 and the data transmitting circuit 9. The data after the clear is writted into the RAM 6.

Here, the data transmitting circuit 9 and the discriminator circuit 8 are disposed in order to reduce the period of time for the operating processing. More specifically, owing to the use of the circuits 8 and 9, unless the data provided from the adder and subtracter 7 and the comparative data provided from the area b of the ROM 1 are coincident, the operated result can be written into the RAM 6 as it is, and if they are coincident, the operated result and the data of the area b of the ROM 1 after the clear can be exchanged by the data transmitting circuit 9 and the data after the clear can be written into the RAM 6, so that the various operating processings can be executed with one instruction word. As a result, the operating processing time can be shortened. The coincidence signal of the discriminator circuit 8 is used for the control of the assignment of the next page stated before. If the control instruction of adding 1 (one) to the time data of the uppermost digit of the RAM 6 is present in the address within the page of the main ROM 1 assigned anew as is stored into the latching circuit 4 by the coincidence signal, the carry can be executed.

It is supposed by way of example that, in the address of the main ROM 1 determined by the timing $T_{10}$ and page 0 (zero), comparative data which corresponds to "10" of a decimal number is being delivered from the main ROM 1 to the discrimination circuit 8 and that the next page data, for example, "1" is set into the latching circuit 4 by the coincidence signal of the discrimination circuit 8. It is also supposed that, in the address of page 1 (one) determined by the timing $T_{11}$, the control instruction of adding "1" into the address $X_1Y_1$ of the RAM 6 provided from the main ROM 1.

As previously stated, in the address determined by the timing $T_{10}$ and page 0 (zero), the 1/100 second-data within the address $X_0Y_1$ of the RAM 6 is read out by the control instruction from the main ROM 1, and "1" is added to the 1/100 second-data by the adder and subtracter 7. When the added result corresponds to the decimal number "10", the coincidence signal is provided from the discrimination circuit 8, and the data after the clear, i.e., data "0" is provided from the data transmitting circuit 9 to the RAM 6. As a result, "0" is written into the address $X_0Y_1$ of the RAM 6. "1" which is the next page data is set into the latching circuit 4 by the coincidence signal from the discrimination circuit 8.

Since page 1 (one) is assigned at the timing $T_{11}$, the control instruction of reading out the 1/10 second-data within the address $X_1Y_1$ of the RAM 6 and adding "1" to this 1/10 second-data is provided from the address of the main ROM 1 determined at the timing $T_{11}$. In consequence, "1" is added to the 1/10 second-data. In other words, the control instruction of renewing the 1/10 second-data by the carry from the 1/100 second-data is provided.

Unless the 1/10 second-data is "10", the 0 (zero) page data will be set into the latching circuit 4 again.

If the 1/10 second-data is "10", the data within the address $X_1Y_1$ of the RAM 6 will be similarly cleared, and the further next page data for renewing the 1 second-data will be set into the latching circuit 4.

In this manner, the minute, the hour, the day and the month can be counted by the successive clears and carries.

The control ROM 13 receives as its inputs the data ($T_0$–$T_{39}$) of the counter 3, the data of the page of the latching circuit 4 and data of an internal state memory circuit 15.

The control ROM 13 consists of a data control ROM **13*a* for controlling a data processing attributed to any internal state of the timepiece, a display flag control ROM 13*b* associated with the display, and an internal state control ROM 13*c* for converting the content of the internal state memory circuit 15**.

The ROMs **13*a* to 13*c* provide various control signals by receiving the outputs of the internal state memory circuit 15, the counter 3 and the latching circuit 4**.

The internal state memory circuit 15 stores what state the timepiece lies in. That is, it stores what display mode and what adjustment mode the timepiece is in now, whether or not an adjustment select digit is to be subjected to "+1", whether or not the stop watch is in the count state, whether or not the alarm is in the set state, etc.

In response to the state memory signal from the internal state memory circuit 15, the timing signal from the counter 3 and the page signal from the latching circuit 4, the data control ROM **13*a* delivers the clear signal, a "1" addition inhibit signal and an adjusting "1" addition control signal to the adder and subtracter 7**.

On the basis of the data of the internal state memory circuit 15 and the data of the counter 3 as well as the latching circuit 4, the display flag control ROM **13*b*** decides if the data of the RAM 6 accessed by the address data provided from the area c of the main ROM 1 by the data of the counter 3 and the latching circuit 4 is to be displayed. When the data is to be displayed, the ROM 13*b* delivers a flag (display) digit clock) to a display digit control ROM 17 and a latching circuit 11.

The converter ROM 13*c* receives the state memory signal of the internal state memory circuit 15, the timing signal of the counter 3 and the page signal of the latching circuit 4, and provides a state memory signal to be renewed from the internal state memory circuit 15.

The converter ROM 13*c* also receives the key code signal set in the latching circuit 4 at the timing $T_{27}$, and provides a state memory signal for a mode alteration.

For example, in case where none of the key switches $S_1$ to $S_4$ is actuated, the data to be set into the latching circuit 4 is made "0", and the absence of the key switch input is detected by the converter ROM 13*c*.

In case where the key switch $S_1$ is actuated, the latching circuit 4 is set at "1" at the timing $T_{27}$. Likewise, in case where the key switch $S_2$, $S_3$ or $S_4$ is actuated, the latching circuit 4 is set at "2", ¢3" or "4" at the timing $T_{27}$. On the basis of the actuation of the key switches $S_1$ to $S_4$ and the state memory signal of the internal state memory circuit 15, the state memory signal of the next mode is provided from the converter ROM 13*c*.

Although not especially restricted, various modes as given in the following Table 2 are selected according to the sequence of actuating of the key switches $S_1$ to $S_4$:

TABLE 2

| No. / No. | $A_0$ | $A_1$ | $A_2$ | $A_3$ | $A_4$ |
|---|---|---|---|---|---|
| $D_0$ | Time Display | Date/Week Display | Stop Watch | | Alarm Display |
| $D_1$ | | | Reset | | |
| $D_2$ | 1 s, 10 s Adjust | Split 0 | | | |
| $D_3$ | | | Lap 0 | | |
| $D_4$ | 1 m Adjust | 1 D, 10 D Adjust | Split 1 | | Alarm 1 m Adjust |
| $D_5$ | 10 m Adjust | | Lap 2 | | Alarm 10 m Adjust |
| $D_6$ | 1 H Adjust | 1 M Adjust | Lap 1 | | Alarm 1 H Adjust |
| $D_7$ | Week Adjust | | Split 2 | | |

$A_0$-$A_4$: classification of display functions
$D_0$-$D_7$: classification of states In a mode $A_0D_0$, the respective time data of 10 H (hours), 1 H, 10 m (minutes), 1 m, 10 s (seconds) and 1 s in the ordinary clock operation are displayed.

Upon depressing the key switch $S_1$ in the mode $A_0D_0$, a mode $A_1D_0$ is established and 10 D (days) and 1 D-data are displayed instead of the 10 s and 1 s-data.

Upon depressing the key switch $S_1$ in the mode $A_1D_0$, the second mode in the mode $A_1D_0$ is established. In this case, the respective display digits are constructed of, for example, segments, and the week display is done by the segments having displayed the 10 D-data and the 1 D-data.

Upon depressing the key switch $S_1$ in the second mode of the mode $A_1D_0$, the mode $A_0D_0$ is returned to.

Upon depressing the key switch $S_2$ in the mode $A_0D_0$, a time adjust mode $A_0D_2$ is established and the display time data of 10 s and 1 s are flashed. Upon depressing the key switch $S_2$ in the mode $A_0D_2$, the time data of 10 s and 1 s are reset to "0".

Upon depressing the key switch $S_1$ in the $A_0D_2$, a mode $A_0D_4$ is established and the display data of 1 m is indicated. By depressing the key switch $S_2$ in this mode $A_0D_4$, the time data of 1 m is renewed the number of times of the depressions of the key switch $S_2$.

Similarly, modes $A_0D_5$, $A_0D_6$ and $A_0D_7$ are successively selected by depressing the key switch $S_1$ after the mode $A_0D_4$. Upon depressing the key switch $S_1$ in the mode $A_0D_7$, the mode $A_0D_0$ is returned to.

Upon depressing the key switch $S_2$ in the mode $A_1D_0$, a mode $A_1D_4$ is established and the display of the time data of 1 D and 10 D is flashed. By depressing the key switch $S_2$ in this mode, the time data of 1 D and 10 D are renewed the number of times of the depressions of the key switch $S_2$.

When the key switch $S_1$ is depressed in the mode $A_1D_4$, a mode $A_1D_6$ is established, the time data of the month is displayed and flashed. As in the above, the content of the flickering display data is renewed by means of the key switch $S_2$. Upon the subsequent depression of the key switch $S_1$, the mode $A_1D_0$ is returned to.

Upon depressing the key switch $S_3$ in the mode $A_0D_0$ or $A_1D_0$, a mode $A_4D_0$ is established, and the alarm set time data within the RAM 6, for example, the alarm set time data of 10 H, 1 H, 10 m and 1 m are dislayed.

Upon depressing the key switch $S_2$ in the mode $A_4D_0$, a mode $A_4D_4$ is established and the display of the alarm time data of 1 m is flashed. By depressing the key switch $S_1$ in this mode $A_4D_4$, the 1 m-alarm time data is renewed the number of times of the depressions.

By similarly depressing the key switch $S_2$ in succession after the mode $A_4D_4$, modes $A_4D_4$, modes $A_4D_5$ and $A_4D_6$ are selected, whereupon the mode $A_0D_0$ is returned to.

By depressing the key switch $S_3$ again in the mode $A_4D_0$, a mode $A_2D_0$ is selected. When this mode $A_2D_0$ is selected, time data for a stop watch stored in the RAM 6, for example, time data of 10 m, 1 m, 10 s, 1 s, 1/10 s and 1/100 s are reset, and the first mode of a mode $A_2D_1$ is established.

Upon depressing the key switch $S_1$ in the first mode of the mode $A_2D_1$, a mode $A_2D_2$ is established to start counting of the time data for the stop watch.

When the key switch $S_1$ is depressed again in the mode $A_2D_2$, the time of the moment of the depression (split time) is displayed. However, the time counting which uses the RAM 6 is continued.

By depressing the key switch $S_1$ again, a time with reference to the time at which the key switch $S_1$ has been depressed in the mode $A_2D_1$ is displayed.

Upon depressing the key switch $S_3$ in the mode $A_2D_2$, the second mode of the mode $A_2D_1$ is established and the stop watch operation is reset.

A mode $A_2D_3$ is established by depressing the key switch $S_3$ in the second mode of the mode $A_2D_1$.

Upon depressing the key switch $S_1$ in the mode $A_2D_3$, the stop watch operation of adding a time is started. Upon depressing the key switch $S_1$ again after a time $T_1$, the counting operation of the stop watch time which uses the RAM 6 is stopped. By depressing the key switch $S_1$ again, the counting operation is started again. When the key switch $S_1$ is depressed after a time $T_2$ from the restarting of the counting operation, the count value of the stop watch using the RAM 6 becomes $(T_1+T_2)$.

The third mode of the mode $A_2D_1$ is established by depressing the key switch $S_3$ similarly to the above.

By depressing the key switch $S_3$ in the third mode of the mode $A_2D_1$, the mode $A_2D_1$ has ended and a mode $A_2D_5$ is established. Upon depressing the key switch $S_1$ in the mode $A_2D_5$, the lap time counting operation of the stop watch is started. By depressing the key switch $S_1$ again, a lap time is displayed.

Upon depressing the key switch $S_3$ in the mode $A_2D_5$, the third mode of the mode $A_2D_1$ is returned to.

The mode $A_0D_0$ or $A_1D_0$ is returned to by depressing the key switch $S_3$ again in the third mode of the mode $A_2D_1$.

As described above, the converter ROM 13*c* assigns the next internal mode of the internal state memory circuit 15 with reference to the present mode.

By depressing the key switch $S_2$ in the mode $A_0D_4$, the content of the latching circuit 4 is altered at the timing $T_{27}$. On the basis of the address at the timing $T_{27}$, the data corresponding to the key switch $S_2$ from the latching circuit 4 and the data of the internal state memory circuit 15, an internal state signal for the adjusting addition of "1" to the 1 minute-data is delivered from the ROM 13*c* to the internal state memory circuit 15. At the next timing $T_{28}$, the 1 minute-data of the RAM 6 is accessed by the main ROM 1. On the other hand, a signal for the "1" adjusting addition is delivered from the ROM 13*a* to the adder and subtractor 7 on the basis of the data of the address and page which are determined by the timing $T_{28}$ and the data of the internal state memory circuit 15 which has been converted. As a result, the 1 minute-data is subjected to the adjusting addition of "1".

In the presence of a carry from, for example, seconds, the main ROM 1*b* intends to add "1" to the minute data by converting the page data in order to execute the processing of the carry. In the mode $A_0D_4$, however, an addition inhibit signal is delivered from the data control ROM 13*a* to the adder and subtracter 7 at the processing of the carry from the second data to the minute data. Likewise, a carry from the minute data to the hour data is inhibited.

The display digit control ROM 17 receives the flag signal of the display flag ROM 13*b* and the state signal from the internal state memory circuit 15, and provides a signal for selecting a digit at which data is displayed.

The control of the flashing, mask and zero mask of the display digit, the week display (alphabet display or dot display), the label display, etc. are made by the display digit control ROM 17.

Numeral 10 designates a display decoder. The display decoder 10 receives the output data of the RAM 6 and the output data of the display digit control ROM 17. The display decoder 10 distinguishes various binary data delivered from the RAM 6, as the data of second, minute, hour, day of week, month etc. on the basis of the control signal of the display digit control ROM 16, and it provides a decode signal for driving segments (not shown) of a display unit.

In response to the signal from the display flag ROM 13*b*, the latching circuit 11 receives the decode signal of the display decoder 10. As a result, the decode signal of causing a plurality of digits of the display unit to indicate the data is held in the latching circuit 11.

The display unit is driven by a display drive circuit 12 which receives the output of the latching circuit 11. As a result, the date, hour, label or the like is displayed by the display unit.

As described above, the control ROM 13 takes charge of the display and operating processings which are attributed to the states of the timepiece, while the main ROM 1 takes charge of the processings which are not attributed to the states of the timepiece, that is, the processings for the general operations as the timepiece, for example, clearing minutes at the value of 60 and generating a carry signal.

The blocks forming the processing instructions are divided according to the sorts of the timepiece as described above, whereby the construction as the system can be made clear. Besides, the blocks for which the necessity for altering the specifications as the timepiece system is high as in case of the method of display are made separate, whereby the alteration of the ROM construction can be easily done.

Regarding the information processings for the clocking, the processing for the clock operation of 1 second or longer may be executed only once in 1 second, and other processings can be done within the period within which no counting is necessary. Accordingly, even when the plurality of control instructions are constructed at an identical timing (address) as stated above, quite no problem is posed. Moreover, rational information processings become possible.

Since the alteration and addition of functions are possible by altering the ROM 1 and ROM 13, the timepiece of this invention is very rich in versatility.

Now, the details of the constructions of the respective blocks in FIG. 1 will be described with reference to FIGS. 2 to 16.

Figure 17:
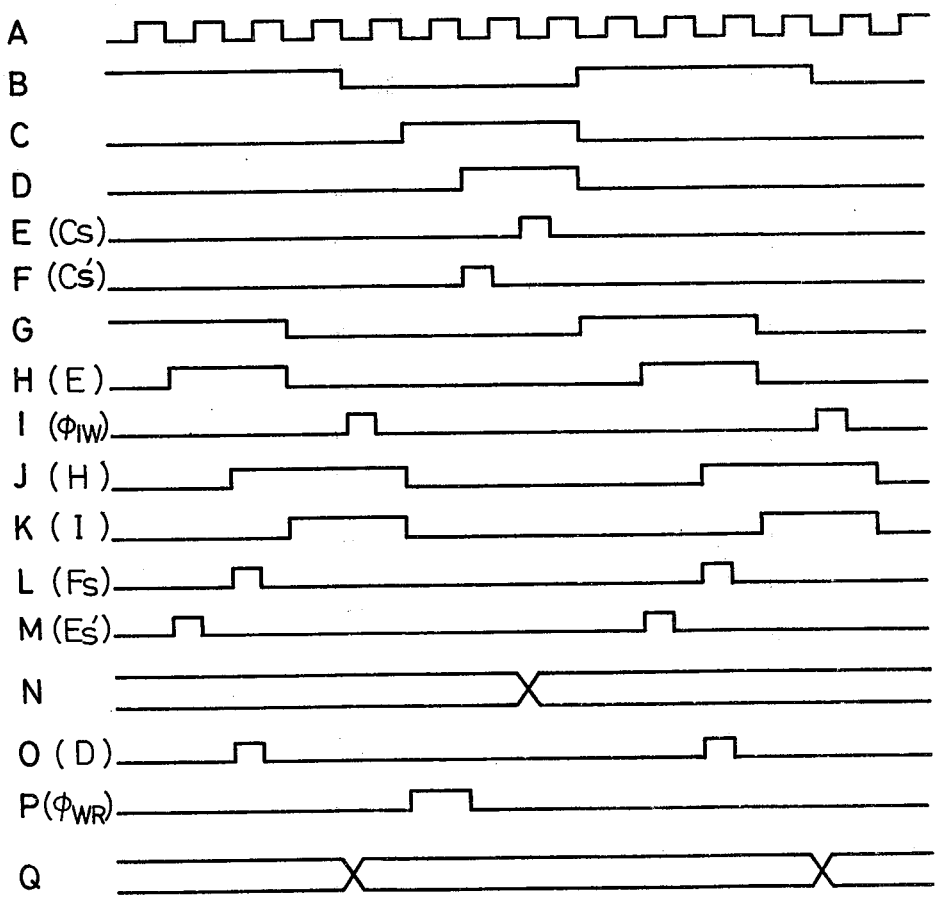
FIG. 17 is an operating timing chart of the electronic multifunction timepiece shown in FIG. 1.

The clock pulse generator circuit 14 contains therein a crystal oscillator circuit (not shown) which generates an original oscillation signal as shown at A in FIG. 17, and it provides various clock signals as shown at B to M and O and P in FIG. 17 on the basis of the original oscillation signal. Although this is not especially restrictive, a negative voltage source is used for the circuit so that a signal at the earth potential may be regarded as a high level or logical value "1" and that a signal at a negative potential may be regarded as a low level or logical value "0". The original oscillation signal shown at A in FIG. 17 is set at, for example, 32 kHz, and the clock signal shown at B in the figure is set at 4 kHz accordingly. As apparent from FIG. 17, the other clock signals are made signals of 4 kHz which are synchronous with the clock signal at B in the figure.

Figure 2:
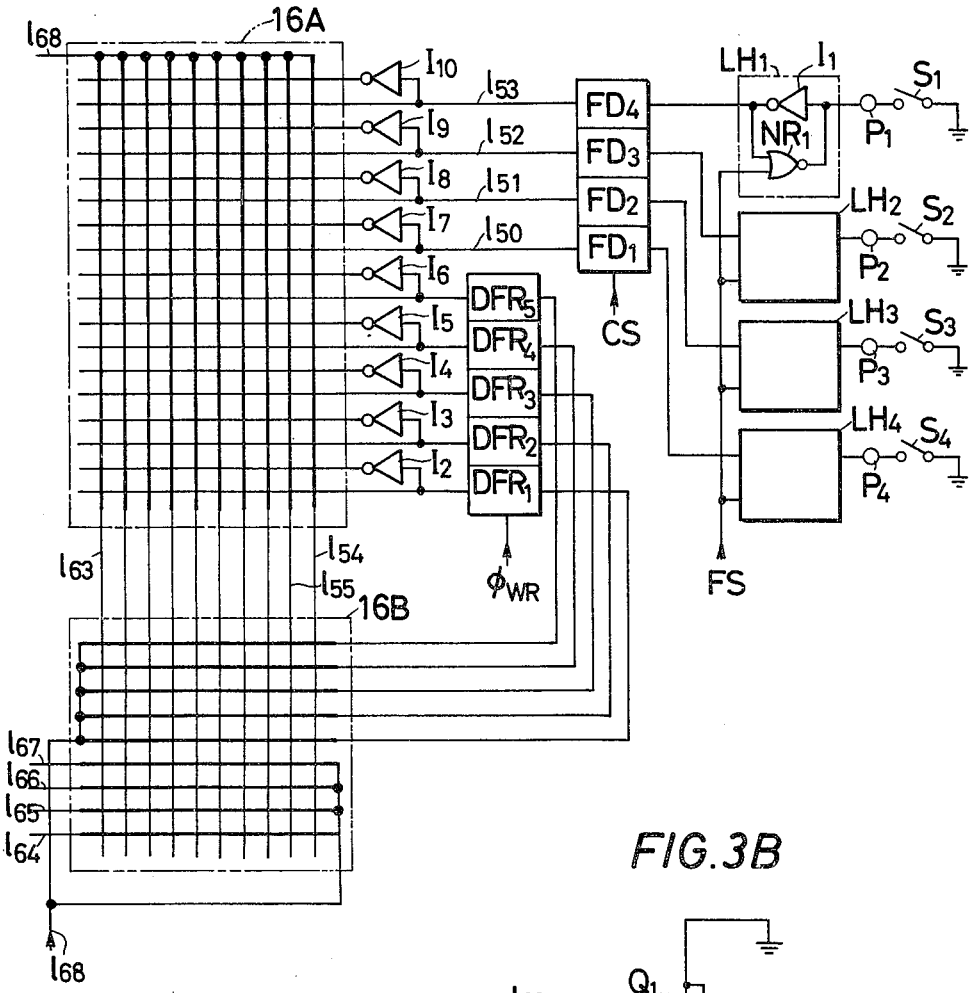
FIG. 2 is a detailed logical circuit diagram of a key input circuit (block 16) in FIG. 1.

Referring to FIG. 2 illustrative of the key input circuit (block 16 in FIG. 1), the key switches $S_1$–$S_4$ are respectively connected to the input ends of latching circuits $LH_1$–$LH_2$ through terminals $P_1$–$P_4$.

The latching circuit $LH_1$ is made up of an inverter circuit $I_1$ and a NOR circuit $NR_1$. In case where the key switch $S_1$ is the "off" state, the output of the NOR circuit $NR_1$ becomes the low level when the clock signal $F_s$ has become the high level. The output of the inverter circuit $I_1$, that is, the output of the latching circuit $LH_1$ is brought into the high level by the low level output of the NOR circuit $NR_1$. Since the inverter circuit $I_1$ and the NOR circuit $NR_1$ form a closed circuit as illustrated in the figure, the above high level output is continued even when the clock signal $F_s$ has become the low level.

Upon turning the key switch $S_1$ "on", the output of the latching circuit $LH_1$ becomes the low level.

The other latching circuits $LH_2$–$LH_4$ have the same arrangement as that of the latching circuit $LH_1$, and provide the low level signals upon turning the respective key switches $S_2$–$S_4$ "on".

The output terminals of the latching circuits $LH_1$–$LH_4$ are respectively connected to the input terminals of the corresponding flip-flop circuits $FD_4$–$FD_1$.

The flip-flop circuits $FD_4$–$FD_1$ provide the same signals as the input signals when the clock signal $C_s$ has become the high level.

The respective output signals of the flip-flop circuits $FD_4$14 $FD_1$ are applied to a key input ROM 16A directly and also through inverter circuits $I_7$–$I_{10}$.

Output signals of the key input ROM 16A are applied to a second key input ROM 16B through lines $l_{54}$–$l_{63}$. Output signals of the key input ROM 16B on one side are applied to flip-flop circuits $DFR_1$–$DFR_5$ which provide the same signals as the input signals upon the high level of the clock signal $\phi_{WR}$. Output signals of the key input ROM 16B on the other side are applied to the page control circuit in FIG. 6 (block 5 in FIG. 1) through lines $l_{64}$–$l_{67}$.

Output signals of the flip-flop circuits $DFR_1$–$DFR_5$ are respectively applied to the key input ROM 16A directly and also through inverter circuits $I_2$–$I_6$.

As shown in FIG. 2, the key input ROMs 16A and 16B have input lines depicted with medium lines and output lines depicted with thick lines. MOSFETs as switching elements are connected at the points of intersection between the input lines and the output lines.

Figure 3B:
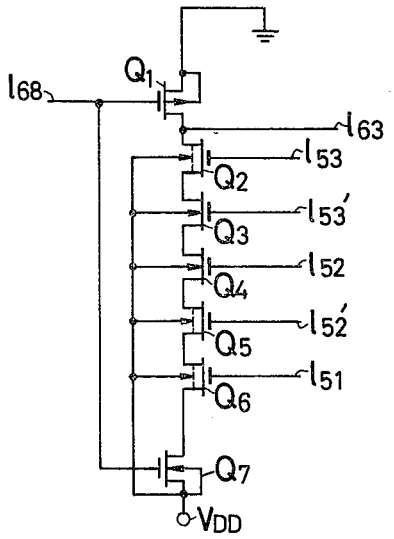
FIG. 3B is a detailed circuit diagram corresponding to the symbol diagram of FIG. 3A.
Figure 3A:
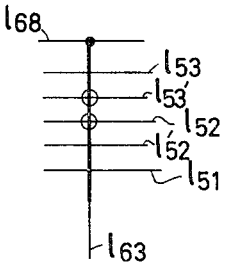

FIG. 3A is a logic symbol diagram of the ROM, while FIG. 3B is a circuit diagram corresponding to FIG. 3A.

As shown in FIG. 3B, the ROM is composed of N-channel MOSFETs $Q_2$–$Q_6$ which receive the input signals, a P-channel MOSFET $Q_1$ which serves to precharge the capacitance (not shown) of the input line $l_{63}$, and an N-channel MOSFET $Q_7$ which is connected in series with the MOSFETs $Q_2$–$Q_6$. In correspondence with FIG. 3A, among the MOSFETs $Q_2$–$Q_6$, those $Q_2$, $Q_5$ and $Q_6$ are rendered the depletion mode. Accordingly, the MOSFETs $Q_2$, $Q_5$ and $Q_6$ becomes the "on" state irrespective of the input signal levels.

The clock signal shown at J in FIG. 17 is impressed on a line $l_{68}$. Since the MOSFET $Q_1$ is brought into the "on" state by the low level of the clock signal on the line $l_{68}$, the output line $l_{63}$ is precharged to the earth potential. The MOSFET $Q_7$ is brought into the "on" state by the high level of the clock signal on the line $l_{68}$. As a result, the NAND signal between signals on input lines $l_{52}$ and $l_{53}$, is delivered to the output line $l_{63}$.

The switching MOSFETs explained with reference to FIGS. 3A and 3B are arranged in the key input ROMs 16A and 16B.

The flip-flop circuits $DFR_1$–$DFR_5$ are used in order to detect the fact that any one of the key switches $S_1$–$S_4$ has been turned from the "on" state to the "off" state.

Although not especially restricted, the flip-flop circuits $DFR_1$–$DFR_5$ are so constructed that when all the key switches $S_1$–$S_4$ are in the "off" state, all the flip-flop circuits receive the "0" signals by means of the key input ROM 16B. In the presence of the key switch in the "on" state, that of the flip-flop circuits $DFR_1$–$DFR_5$ which corresponds to the key turned "on" receives the "1" signal.

The key input ROM 16B delivers the high level signal to the line $l_{64}$ when the key switches are "off". It also delivers a key code signal corresponding to the key switch turned "on", to the three lines $l_{65}$–$l_{67}$.

The operation of the key input circuit is as stated below.

It is supposed by way of example that the key switch $S_1$ is put into the "on" state. Then, among lines $l_{50}$–$l_{53}$, the line $l_{53}$ becomes the low level.

The low level signal is delivered from the key input ROM 16B to the line $l_{64}$ in correspondence with the low level of the line $l_{53}$, while the key code signal which is, for example, "100" is delivered to the lines $l_{65}$–$l_{67}$. Simultaneously, the "1" level signal is delivered from the key input ROM 16B to the flip-flop circuit $DFR_1$. The flip-flop circuit $DFR_1$ provides the "1" level signal of the input at its output terminal on condition that the clock signal $\phi_{WR}$ becomes the high level.

The key "on" signal on the line $l_{64}$ and the key code signal on the lines $l_{65}$–$l_{67}$ are provided during the period during which the key switch $S_1$ is held in the "on" state.

Upon putting the key switch $S_1$ into the "off" state, the signal of the line $l_{53}$ becomes the "1" level again. The output signal of the flip-flop circuit $DFR_1$, however, is kept at the "1" level until the clock signal $\phi_{WR}$ becomes the high level again. In response to the "1" level of the line $l_{53}$ and the "1" level of the flip-flop circuit $DFR_1$, the key input ROM 16B delivers the "1" level signal to the line $l_{64}$ and the "0" level signals to the lines $l_{65}$–$l_{67}$.

Likewise, in correspondence with the "on" states of the respective key switches $S_2$–$S_4$, the code signals on the lines $l_{65}$–$l_{67}$ are made "010", "001" and "110" by way of example. The signal on the line $l_{64}$ is made the "0" level when the key switch is "on", and the "1" level when the key switch is "off".

Figure 4:
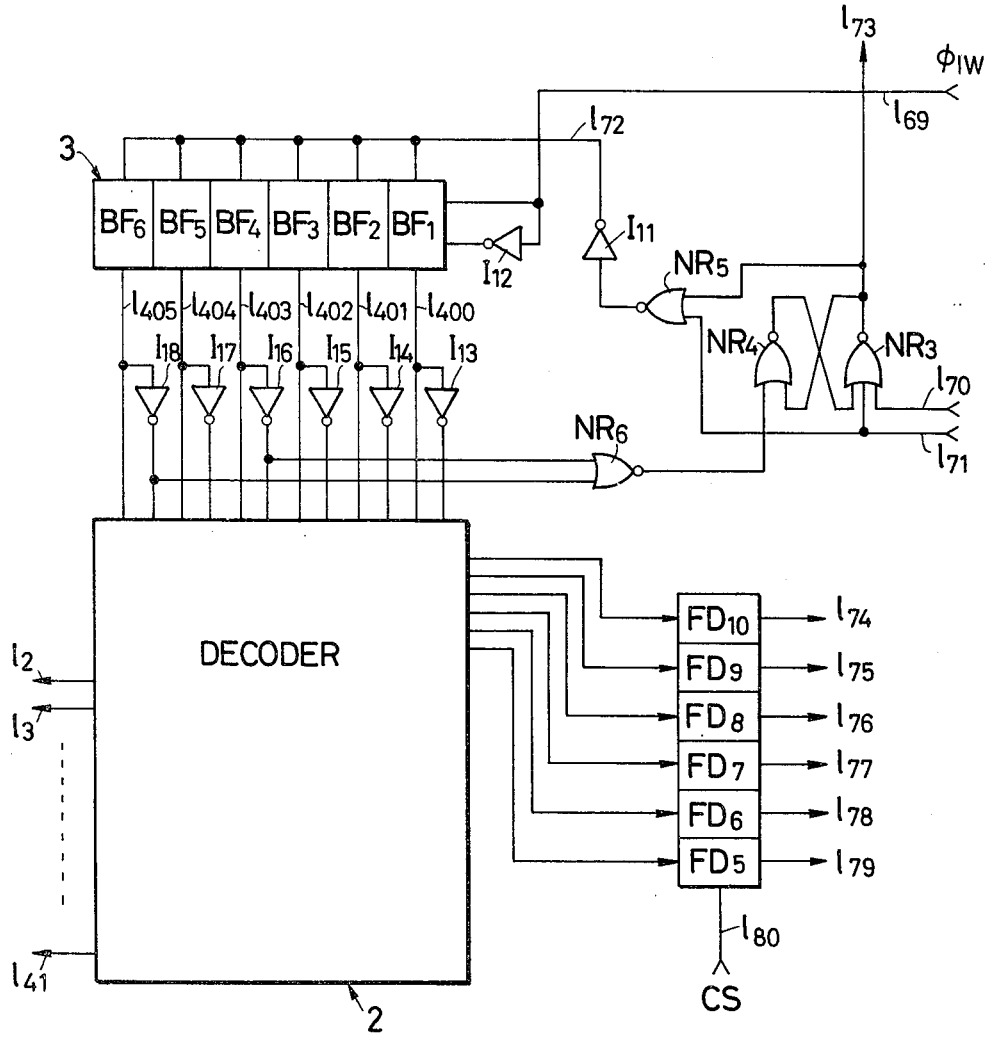
FIG. 4 is a detailed logical circuit diagram showing a decoder and a counter (blocks 2 and 3) in FIG. 1.

The decoder 2 shown in FIG. 4 has substantially the same construction as that of the ROM 16A or 16B in FIG. 2. The decoder 2 is supplied with the clock signal shown at C in FIG. 17.

The decoder circuit 2 receives the count signal of 6 bits from the counter 3 in FIG. 4 directly and also through inverter circuits $I_{13}$–$I_{18}$. It delivers timing signals which become the "1" level in sequence, to forty lines $l_2$–$l_{41}$. The lines $l_2$–$l_{41}$ are connected to the corresponding lines of the main ROM shown in FIG. 5.

The decoder circuit 2 also delivers timing signals to flip-flop circuits $FD_5$–$FD_{10}$ which provide the same signals as input signals in synchronism with the clock signal $C_s$ respectively. As a result, timing signals for circuits to be described later are provided from the respective flip-flop circuits $FD_5$–$FD_{10}$.

The counter 3 is composed of 6-bit binary counters $BF_1$–$BF_6$, an inverter circuit $I_{12}$ for inverting the clock signal, NOR circuits $NR_3$–$NR_6$ constituting gates, and an inverter $I_{11}$.

The clock signal $\phi_{1W}$ of 4 kHz shown at I in FIG. 17 is applied to lines $l_{69}$ and $l_{70}$, and a test signal which is put into the high level only when the circuit is tested is applied to a line $l_{71}$ from outside the circuit.

The NOR circuit $NR_6$ receives NOT signals of the binary counters $BF_4$ and $BF_6$, and the latching circuit is set by the NOR circuits $NR_3$ and $NR_4$. The output of the NOR circuit $NR_3$ is supplied to a reset terminal of the binary counters $BF_1$–$BF_6$ through the NOR circuit $NR_5$ and the inverter circuit $I_{11}$.

Output binary values of the binary counters $BF_4$ and $BF_6$ have weights of "8" and "32", respectively. Therefore, forth clock pulses $\phi_{1W}$ of 4 kHz have been impressed on the line $l_{69}$, a reset signal is provided from the inverter circuit $I_{11}$.

As a result, the counter 3 operates as a divide-by-40 counter in which one cycle is 1/100 second.

The output of the NOR circuit $NR_3$ is connected to a corresponding line in FIG. 6 through a line $l_{73}$.

Figure 13:
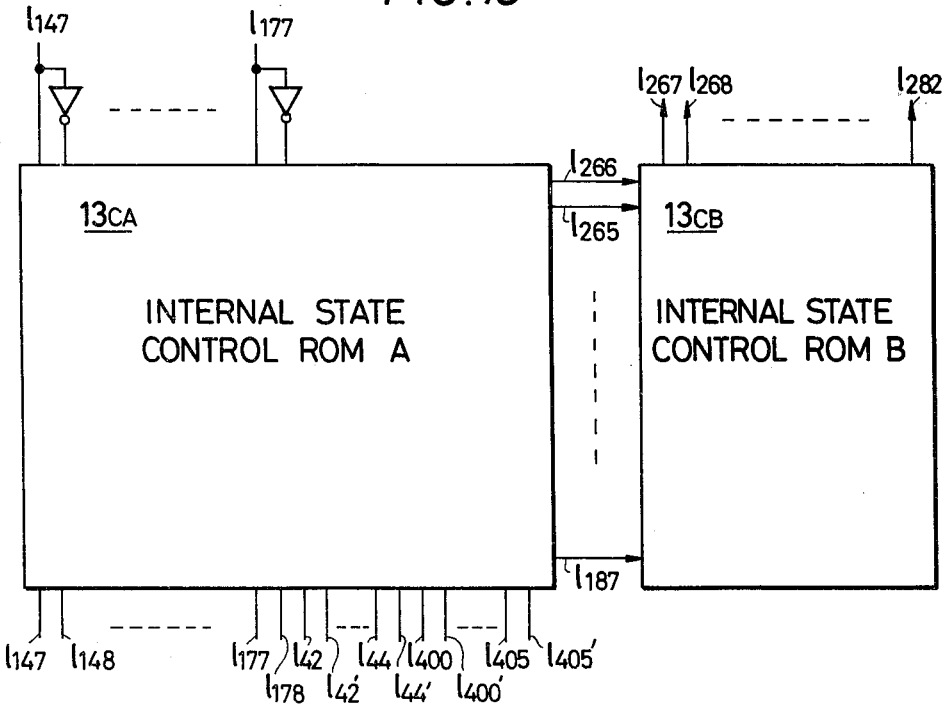
Figure 11:
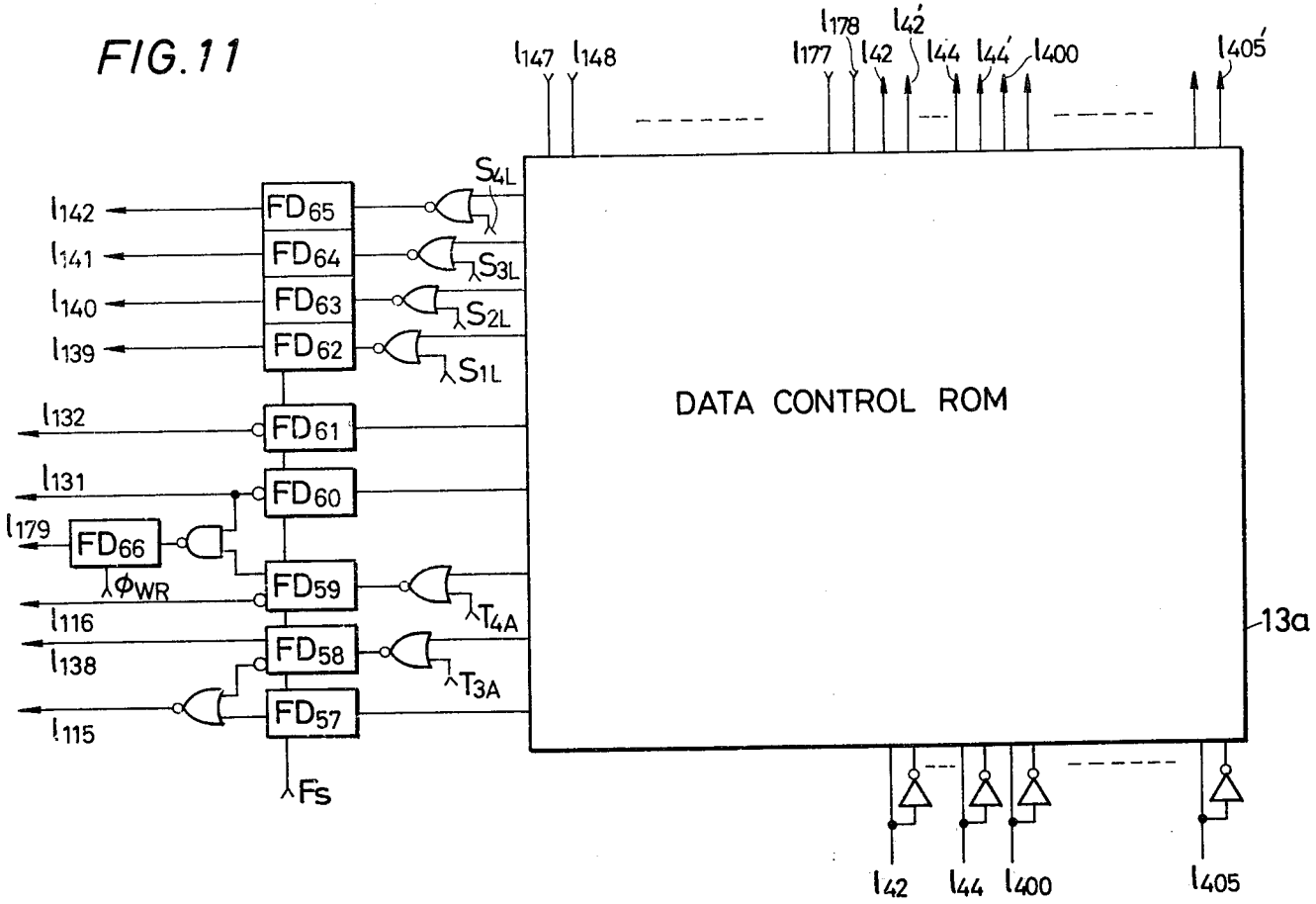
Figure 12:
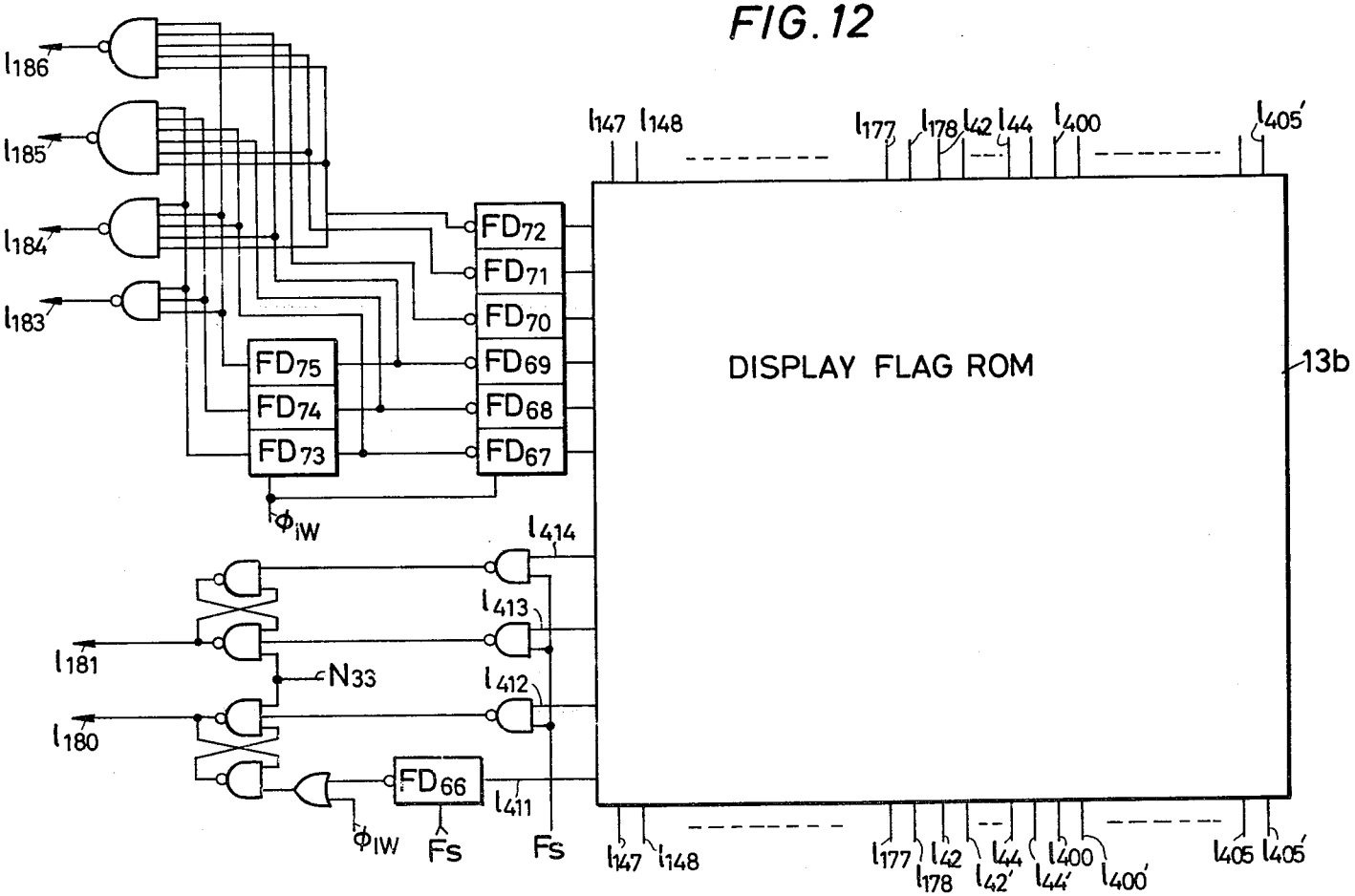

Output lines $l_{400}$–$l_{405}$ of the respective binary counters $BF_1$–$BF_6$ are connected to corresponding lines in FIGS. 11 to 13.

Figure 5:
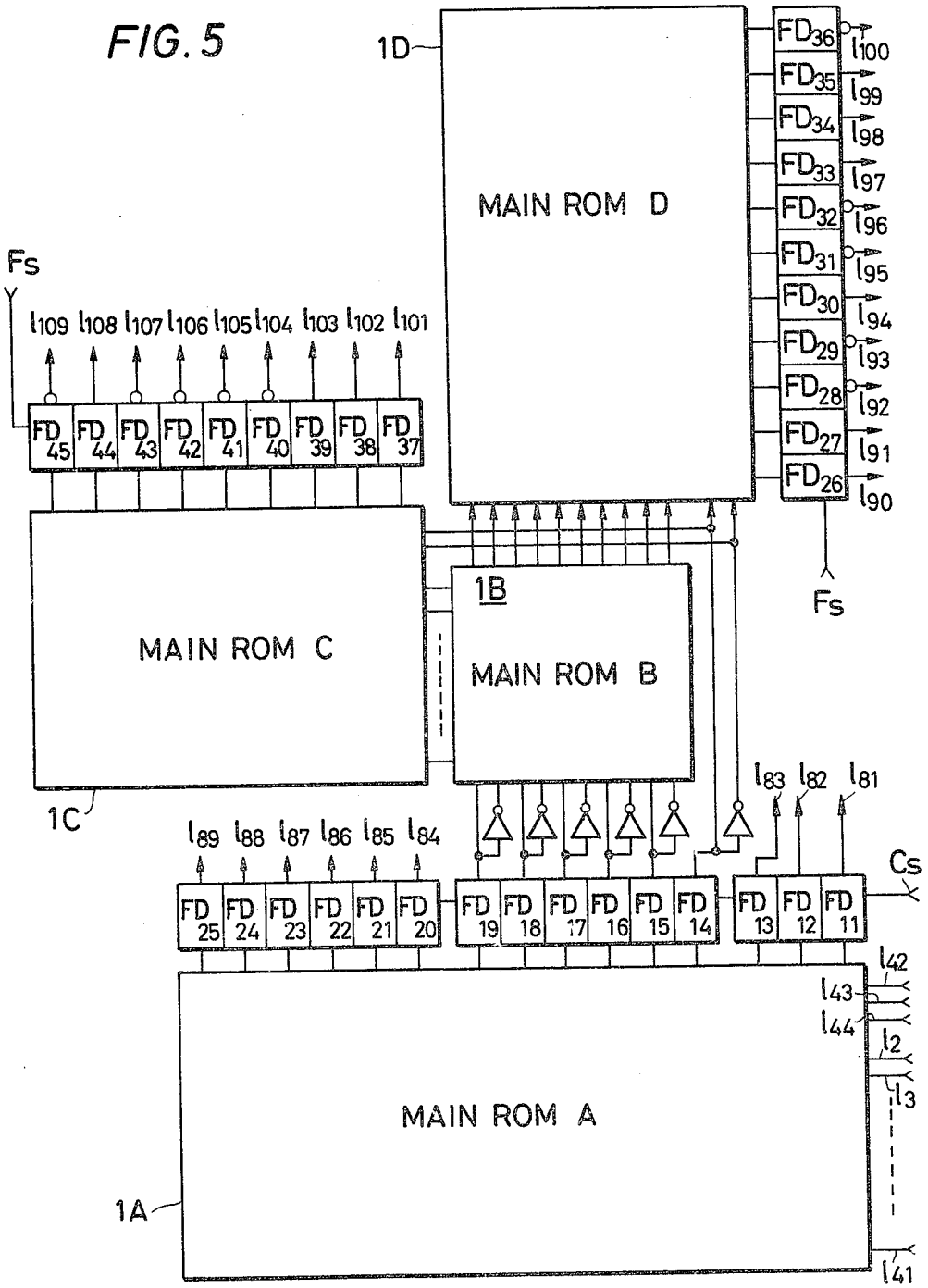
FIG. 5 is a detailed logical circuit diagram of a main ROM (block 1) in FIG. 1.

The main ROM in FIG. 5 is constructed of four divided ROMs 1A–1D.

The ROM 1A receives the timing signals as an address signal from the decoder 2 of FIG. 4 at input lines $l_2$–$l_{41}$, and receives the page signal of 3 bits from the latching circuit of FIG. 6 to be described later at lines $l_{42}$–$l_{44}$. A plurality of control instructions are stored in an address selected by the address signal applied to the input lines $l_2$–$l_{41}$. One of the plurality of control instructions is selected by the page signal applied to the lines $l_{42}$–$l_{44}$.

This ROM 1A has its operation controlled by the clock signal shown at D in FIG. 17.

The ROM 1A delivers the next page signal to three flip-flop circuits $FD_{11}$–$FD_{13}$. The flip-flop circuits $FD_{11}$–$FD_{13}$ deliver the same signal as the next page signal of the input to lines $l_{81}$–$l_{83}$ in synchronism with the high level of the clock signal $C_s$. The next page signal on the lines $l_{81}$–$l_{83}$ is supplied to the page control circuit shown in FIG. 6.

The ROM 1A also delivers control signals including comparative data and an addition signal, to six flip-flop circuits $FD_{14}$–$FD_{19}$.

Figure 10:
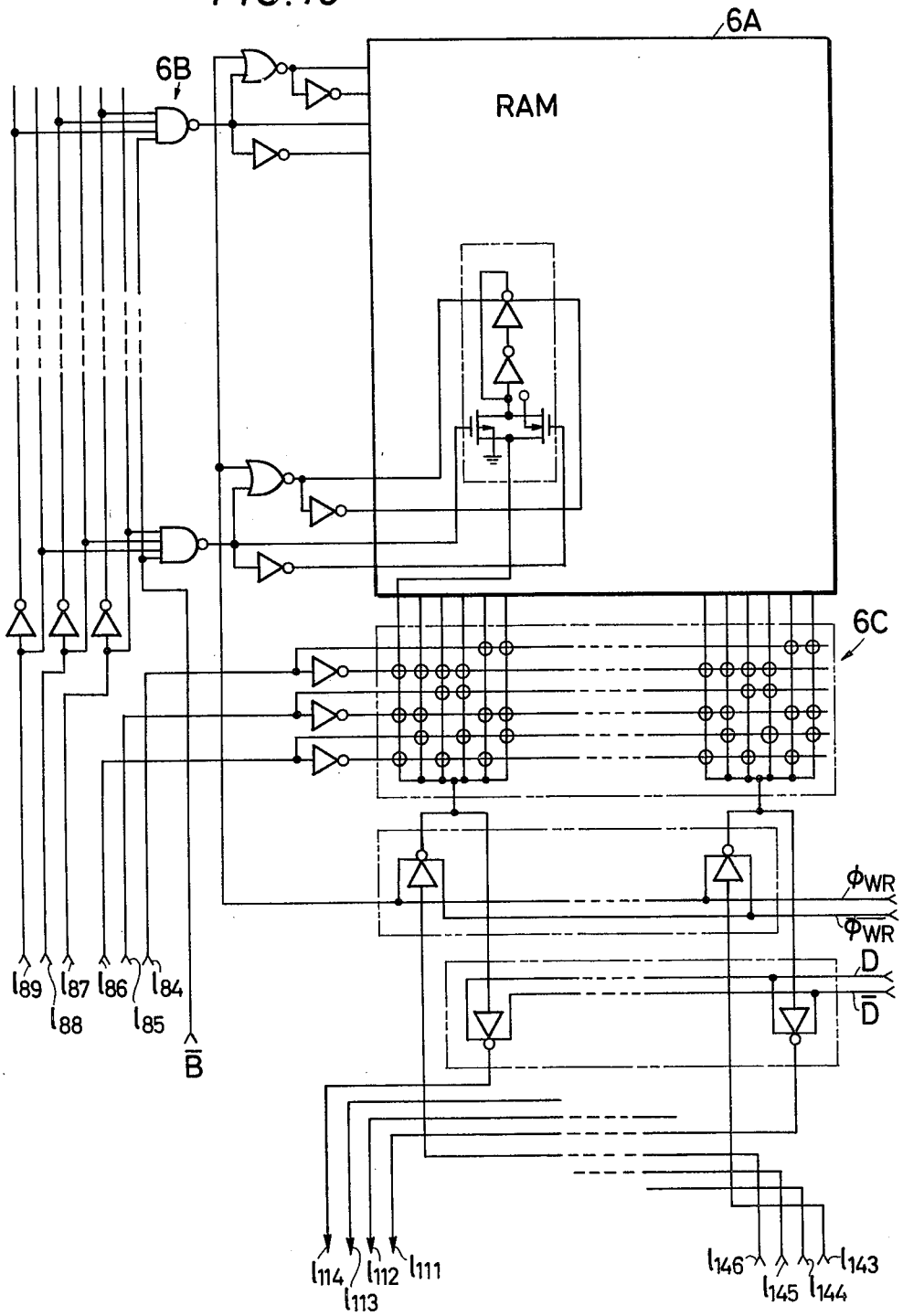
FIG. 10 is a detailed logical circuit diagram of a RAM (block 6) in FIG. 1.

Further, the ROM 1A delivers address signal to six flip-flop circuits $FD_{20}$–$FD_{25}$. The address signals of the flip-flop circuits $FD_{20}$–$FD_{25}$ are supplied to the RAM in FIG. 10 through lines $l_{84}$–$l_{89}$ respectively. Although this is not essential, the RAM of FIG. 10 is selected in two dimensions. Therefore, one address signal is constructed of the 3 bits of the lines $l_{84}$–$l_{86}$, while the other address signal is constructed of the 3 bits of the lines $l_{87}$–$l_{89}$.

Output signals of those $FD_{15}$–$FD_{19}$ of the flip-flop circuits $FD_{14}$–$FD_{19}$ which receive the outputs of the ROM 1A are supplied to the ROMs 1B and 1D directly and also through inverter circuits.

An output signal of the flip-flop circuit $FD_{14}$ is supplied as column select signals to the ROMs 1C and 1D directly and also through an inverter circuit.

The ROM 1C receives output signals of the ROM 1B, and delivers control signals to flip-flop circuits $FD_{37}$–$FD_{45}$.

The ROM 1D delivers control signals to flip-flop circuits $FD_{26}$–$FD_{36}$.

In order to supply the control signals to the flip-flop circuits $FD_{26}$–$FD_{45}$, the ROMs 1B–1D can also be constructed as a single ROM like the ROM 1A. By the division as stated above, however, it is possible to omit the area of the ROM which is not used.

The flip-flop circuit $FD_{26}$ receives a clock signal for flip-flop circuits $FD_{53}$–$FD_{56}$ in the discrimination circuit in FIG. 8 to be described later, that is, a write control signal.

Figure 8:
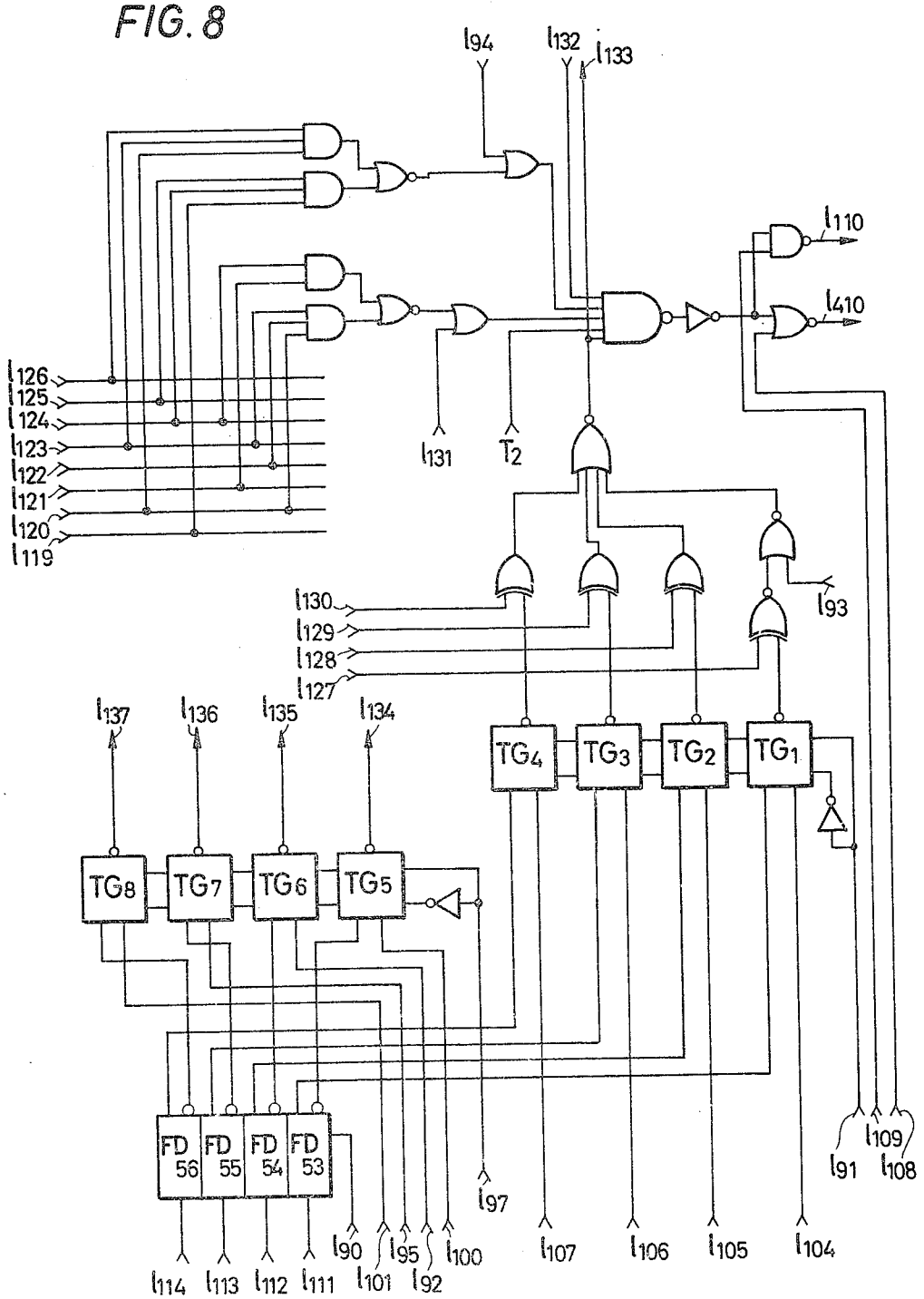
FIG. 8 is a detailed logical circuit diagram of a discriminator circuit (block 8) in FIG. 1.

The flip-flop circuit $FD_{27}$ receives a control signal for multiplexors $TG_1$–$TG_4$ in FIG. 8.

The flip-flop circuits $FD_{28}$, $FD_{31}$, $FD_{36}$ and $FD_{37}$ receive data for one-side inputs of multiplexors $TG_5$–$TG_8$ in FIG. 8. The data of the flip-flop circuits $FD_{28}$, $FD_{31}$, $FD_{36}$ and $FD_{37}$ are made data after the clear to be entered into the RAM of FIG. 10, through the multiplexors $TG_5$–$TG_8$, and they are respectively endowed with weights of, for example, "2", "4", "1" and "8".

The flip-flop circuit $FD_{29}$ receives a data coincidence detection-inhibit signal for the discrimination circuit in FIG. 8.

The flip-flop circuit $FD_{30}$ receives a month data discrimination-instruction signal for the discrimination circuit in FIG. 8.

The flip-flop circuit $FD_{32}$ receives a subtraction control signal for the adder and subtractor shown in FIG. 7.

The flip-flop circuit $FD_{33}$ receives a control signal for the multiplexor $TG_5$–$TG_8$ in FIG. 8.

Figure 9:
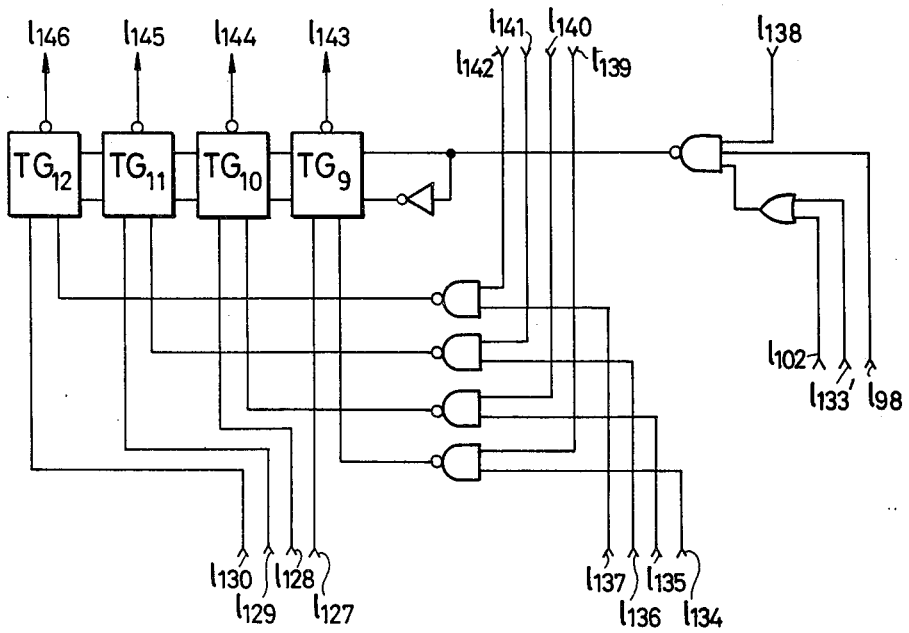
FIG. 9 is a detailed logical circuit diagram of a data transmitting circuit (block 9) in FIG. 1.

The flip-flop circuit $FD_{34}$ receives a clear instruction signal for the data transmitting circuit shown in FIG. 9.

The flip-flop circuit $FD_{38}$ receives a clear inhibit signal for the data transmitting circuit in FIG. 9.

The flip-flop circuit $FD_{39}$ receives an addition control signal for the adder and subtracter in FIG. 7.

The flip-flop circuits $FD_{40}$–$FD_{43}$ receive comparative data signals for the discrimination circuit in FIG. 8. The input signals of the flip-flop circuits $FD_{40}$–$FD_{43}$ are respectively endowed with weights of, for example, "8", "4", "2" and "1".

The flip-flop circuit $FD_{44}$ receives a signal for inhibiting the alteration of page data for the discrimination cricuit of FIG. 8, while the flip-flop circuit $FD_{45}$ receives for forcibly altering the page data for the circuit of FIG. 8.

FIG. 6 shows the page control circuit, and the latching circuit composed of flip-flop circuits $FD_{46}$–$FD_{48}$ which receive the outputs of the page control circuit.

The page control circuit receives a page alteration signal at a line $l_{110}$ and a one-page alteration signal at a line $l_{410}$ from the discrimination circuit of FIG. 8. The next page signal which is supplied to the lines $l_{81}$–$l_{83}$ from the main ROM in FIG. 5 has weights of "1", "2" and "4" in the respective bits. The next page signal from the main ROM is made an even value, so that the signal of the line $l_{81}$ of the weight "1" is "0".

When the page alteration signal on the line $l_{110}$ has become "1", the respective bit signals of the next page signal on the lines $l_{81}$–$l_{83}$ are applied to the flip-flop circuits $FD_{46}$–$FD_{48}$ constituting the latching circuit through AND circuits, NOR circuits and NAND circuits. In this case, the even page signal is supplied to the lines $l_{81}$–$l_{83}$ as described above, so that the input of the flip-flop circuit $FD_{46}$ becomes "0".

On condition that the page alteration signal of the line $l_{110}$ and the one-page alteration signal of the line $l_{410}$ become "1", the bit signals of the page signal on the lines $l_{82}$ and $l_{83}$ are respectively applied to the flip-flop circuits $FD_{47}$ and $FD_{48}$. The flip-flop circuit $FD_{46}$ receives the "1" signal from the line $l_{410}$. As a result, the page signal which is applied to the flip-flop circuits $FD_{46}$–$FD_{48}$ becomes an odd value. That is, it becomes a signal which is obtained by adding "1" to the page signal of the lines $l_{81}$–$l_{83}$.

As previously stated, the key code signal from the key input circuit of FIG. 2 is applied to the lines $l_{65}$–$l_{67}$. The timing signal is applied to a line $L_{74}$ from the flip-flop circuit $FD_{10}$ in FIG. 4. The timing signal of the flip-flop circuit $FD_{10}$ is made the high level at the timing $T_{27}$ at the time when the count value of the counter 3 has become "27". That is, the timing $T_{27}$ is a timing for loading the key code signal. The flip-flop circuits $FD_{46}$–$FD_{48}$ in FIG. 6 receive the key code signal from the lines $l_{65}$–$l_{67}$ at the timing $T_{27}$.

Although this is not especially restrictive, the timing $T_{25}$ is made a detection timing for the "off" state of the key switch. Therefore, the timing signal of the timing $T_{25}$ is delivered from the flip-flop circuit $FD_9$ to the line $l_{75}$.

At the timing $T_{25}$, the key "off" signal applied from the key input circuit of FIG. 2 to the line $l_{64}$ is entered into the flip-flop circuit $FD_{46}$.

In the arrangement of FIG. 6, an all-clear signal AC and an inverted signal $\overline{AC}$ thereof are supplied from outside the circuit, and a binary counter $BF_7$ receives the clock signal at a line $l_{73}$ from the counter 3 in FIG. 4.

On condition that the all-clear signal AC becomes "1", the next page signal or the key code signal is prevented from entering the flip-flop circuits $FD_{46}$–$FD_{48}$. Then, the flip-flop circuit $FD_{46}$ is supplied by the binary counter $BF_7$ with a signal which is inverted every 1/100 second. That is, the "0" page signal and the "1" page signal are alternately provided from the flip-flop circuit $FD_{46}$ at the all-clear. As will be explained later, the stored data in the RAM 6 is cleared under control of the control ROM 13 in the all-clear mode.

The adder and subtracter shown in FIG. 7 deliver operated binary data of 4 bits to lines $l_{127}$–$l_{130}$.

In the following cases (1) and (2), the 4-bit binary data which are delivered to the lines $l_{127}$–$l_{130}$ are such that "1" is added to binary data of 4 bits which are delivered from flip-flop circuits $FD_{49}$–$FD_{52}$:

(1) An adjusting "1" addition-control signal which is applied from the data control ROM in FIG. 11 to a line $l_{116}$ is "1".

(2) A "1" addition-inhibit signal which is applied from the data control ROM in FIG. 11 to a line $l_{115}$ is "0", and besides, the addition control signal which is applied from the main ROM in FIG. 5 to a line $l_{103}$ is "1".

When the addition control signal on the line $l_{103}$ is "1" and besides the subtraction control signal applied from the main ROM in FIG. 5 to a line $l_{96}$ is "1", the binary data which are delivered to the lines $l_{127}$–$l_{130}$ become such that "1" is subtracted from the binary data of the flip-flop circuits $FD_{49}$–$FD_{52}$.

The binary data on the lines $l_{127}$–$l_{130}$ are supplied to corresponding lines in FIGS. 8 and 9.

The flip-flop circuits $FD_{49}$–$FD_{52}$ are supplied with binary data of 4 bits from the RAM shown in FIG. 10 and through lines $l_{111}$–$l_{114}$.

In the discrimination circuit of FIG. 8, lines $l_{119}$–$l_{126}$ are supplied with binary signals of 4 bits from corresponding lines in FIG. 7. The signals of the lines $l_{120}$, $l_{122}$, $l_{124}$ and $l_{126}$ are respectively endowed with weights of "1", "2", "4" and "8". As apparent from FIG. 7, the line $l_{119}$ is supplied with the signal from an inverter circuit which receives the signal of the line $_{120}$. Accordingly, the signal of the line $l_{129}$ is the inverted signal of the signal of the line $l_{120}$. Likewise, the signals on the lines $l_{121}$, $l_{123}$ and $l_{125}$ become the inverted signals of the signals on the lines $l_{122}$, $l_{124}$ and $l_{126}$ respectively.

By an AND circuit which receives the signals of the lines $l_{120}$, $l_{123}$ and $l_{126}$, binary data corresponding to a decimal number of "9" or "11" is detected.

By an AND circuit which receives the signals of the lines $l_{119}$, $l_{124}$ and $l_{124}$, binary data corresponding to "4" or "6" is detected.

By an AND circuit which receives the signals of the lines $l_{121}$ and $_{124}$, binary data corresponding to "4", "5", "12" or "13" is detected.

By an AND circuit which receives the signals of the lines $l_{120}$, $l_{122}$ and $l_{123}$, binary data corresponding to "3" or "11" is detected.

A month discrimination signal is applied to a line $l_{94}$ from the main ROM in FIG. 5. When the binary data of the lines $l_{119}$–$l_{126}$ have become month data, the signal of the line $l_{94}$ is made "0". As a result, an OR circuit which receives the signal of the line $l_{94}$ provides a signal "0" when the month data are "4", "6", "9" and "11", that is, they indicate months with thirty days.

A control signal for the time adjustment is applied to a line $l_{131}$ from the data control ROM in FIG. 11. In the second adjusting mode, the signal of the line $l_{131}$ is made "0" when the binary data of the lines $l_{119}$–$l_{126}$ have become time data of the ten-second digit. As a result, an OR circuit which receives the signal of the line $_{131}$ provides a signal "0" when the data of the ten-second digit are "3" to "5" or indicate 30 seconds or greater.

A forced pass signal is applied to a line $l_{132}$ from the data control ROM. Since signals of lines $l_{110}$ and $l_{410}$ are supplied to the page control circuit in FIG. 6, the page alteration is forcibly instructed by the signal of the line $l_{132}$.

Lines $l_{111}$–$l_{114}$ are supplied with output signals from the RAM in FIG. 10.

The flip-flop circuits $FD_{49}$–$FD_{52}$ in FIG. 7 load binary signals from the RAM with the clock signal $F_s$, whereas the flip-flop circuits $FD_{53}$–$FD_{56}$ in FIG. 8 load the binary signals from the RAM with the control signal applied to the line $l_{90}$ from the main ROM in FIG. 5.

The flip-flop circuits $FD_{53}$–$FD_{56}$ are used as temporary storage circuits for data such as alarm time data.

The multiplexor $TG_1$ has two input lines, an input line which receives the output of the flip-flop circuit $FD_{53}$ and an input line which receives the output from the main ROM of FIG. 5 through a line $l_{104}$. The multiplexor $TG_1$ selects the signal of one of the two input lines with the control signal which is supplied from the main ROM of FIG. 5 through a line $l_{91}$, and it delivers the inverted signal thereof to an output line.

Also the multiplexors $TG_2$–$TG_4$ select the signals of two input lines, respectively.

When the output binary signals of the multiplexors $TG_1$–$TG_4$ have coincided with the output binary signals of the adder and subtracter circuit of FIG. 7 applied to the lines $l_{127}$–$l_{130}$, a signal of "1" level is delivered to a line $l_{133}$.

The multiplexors $TG_5$–$TG_8$ select either the output binary signals of the flip-flop circuits $FD_{53}$–$FD_{56}$ or the clear signals from the main ROM of FIG. 5 as applied to lines $l_{100}$, $l_{92}$, $l_{95}$ and $l_{101}$, with the control signal from the main ROM as applied to a line $l_{97}$, and it deliver the selected signals to output lines $l_{134}$–$l_{137}$.

The signals of the output lines $l_{134}$–$l_{137}$ are supplied to the data transmitting circuit in FIG. 9.

The data transmitting circuit of FIG. 9 receives binary data signals which are applied from the data control ROM in FIG. 11 to lines $l_{139}$–$l_{142}$, a data clear control signal which is applied to a line $l_{138}$, and the inverted signal of the signal of the output line $l_{133}$ of the discrimination circuit in FIG. 8 as is applied to a line $l_{133'}$.

Multiplexors $TG_9$–$TG_{12}$ select either binary data signals which are applied to lines $l_{127}$–$l_{130}$ from the adder and subtracter circuit in FIG. 7 or output signals from four NAND circuits which receive signals on lines $l_{134}$–$l_{137}$ and the signals on the lines $L_{139}$–$l_{142}$, and they deliver the inverted signals of the selected signals to lines $l_{143}$–$l_{146}$.

In case of clearing data in accordance with an operation mode of the timepiece, the signal of the line $l_{138}$ is made "0". In case of clear the data by means of the main ROM, the clear instruction signal of the line $l_{98}$ is made "0". When the discrimination circuit of FIG. 8 has detected the coincidence of data, the signal of the line $l_{133'}$ becomes "0". By "0" of any one of the signals of the lines $l_{138}$, $l_{98}$ and $l_{133'}$, the multiplexors select the clear data signals from the four NAND circuits. However, when a clear inhibit signal applied from the main ROM to a line $l_{102}$ is "1", "0" of the line $l_{133'}$ is made ineffective.

FIG. 10 is a circuit diagram of the RAM. This RAM is made up of a memory array 6A, address decoders 6B and 6C, and a read and write control circuit.

In the block of the memory array 6A, one memory cell is depicted. As shown in the figure, the memory cell is constructed of an inverter circuit, a clocked inverter circuit, and a pair of P-channel and N-channel MOSFETs which are connected in parallel and which constitute a transfer gate.

In the period in which the clocked inverter circuit is operating, a closed circuit is formed of the clocked inverter circuit and the inverter circuit. Data is stored by this closed circuit. The stored data at this time can be read out through the transfer gate which is turned "On" by the address decoder 6B.

While the clocked inverter circuit is not operating, the closed circuit is not established. At this time, data to be stored is applied to an input terminal of the inverter circuit through the transfer gate.

The address decoder 6B is composed of a plurality of NAND circuits which receive the address signal on the lines $l_{87}$–$l_{89}$ directly and also through inverter circuits. The plurality of NAND circuits provide an X-address signal for the memory array 6A. In correspondence with the 3-bit address signal of the lines $l_{87}$–$l_{89}$, the output of the selected one of the NAND circuits becomes "0". By "0" of the output of this NAND gate, the transfer gate of the corresponding memory cell is brought into the "on" state.

The address decoder 6C is composed of transfer gates which receive the address signal on the lines $l_{84}$–$l_{86}$ directly and also through inverter circuits. A plurality of input and output lines of the memory array are selected by the transfer gates.

The write and read control circuit is composed of a plurality of clocked inverter circuits which receive the clock signal $\phi_{WR}$, NOR circuits, and inverter circuits which receive outputs of the NOR circuits.

When the clock signal $\phi_{WR}$ is at the "1" level, the clocked inverter circuits which receive input signals from lines $l_{143}$–$l_{146}$ respectively become the non-operating state.

When the clock signal $\phi_{WR}$ is at the "0" level, the clocked inverter circuits which receive input signals from the lines $l_{143}$–$l_{146}$ respectively become the operating state. Simultaneously, the clocked inverter circuit of the memory cell selected by the address decoder 6B becomes the operating state. As a result, the input signals of the lines $l_{143}$–$l_{146}$ are written into the memory cell selected by the address decoders 6B and 6C.

On condition that the clock signal D becomes the "1" level, the clocked inverter circuits whose outputs are connected to lines $l_{111}$–$l_{114}$ become the operating state. As a result, the stored data of the selected memory cell is delivered to the lines $l_{111}$–$l_{114}$.

The data control ROM in FIG. 11 receives at the input lines $l_{42}$–$l_{44}$ the page data signal from the latching circuit constructed of the flip-flop circuits $FD_{46}$–$FD_{48}$ in FIG. 6, receives at input lines $l_{400}$–$l_{405}$ the timing signals from the counter in FIG. 4, and receives at input lines $l_{147}$–$l_{178}$ state storage signals from an internal state storage circuit in FIG. 14 to be stated later.

Depending upon the states of the input lines, the data control ROM delivers an addition inhibit control signal to a flip-flop circuit $FD_{57}$ and delivers a clear control signal to the flip-flop circuit $FD_{58}$. A NOR circuit which is disposed on the input side of the flip-flop circuit $FD_{58}$ is for testing the circuit, and it receives a test signal $T_{3A}$ which is made the high level at the test.

The clear and addition control signal for the adder and subtracter circuit of FIG. 7 is delivered to a line $l_{115}$ by a NOR circuit which receives an output signal of the flip-flop circuit $FD_{57}$ and an inverted output signal of the flip-flop circuit $FD_{58}$. The clear control signal is delivered to a line $l_{138}$.

The time adjusting addition control signal is applied to a flip-flop circuit $FD_{59}$, and the control signal for the time adjustment is applied to a flip-flop circuit $FD_{60}$.

The forced pass control signal is applied to a flip-flop circuit $FD_{61}$.

Binary data signals are applied to flip-flop circuits $FD_{62}$–$FD_{65}$. NOR circuit which are disposed on the input sides of the flip-flop circuits $FD_{62}$–$FD_{65}$ serve for tests, and receive binary signals at terminals $S_{1L}$–$S_{4L}$ from outside the circuit at the time of tests.

The display flag control ROM in FIG. 12 has input lines similar to those of the data control ROM in FIG. 11.

The display flag control ROM supplies a line $l_{412}$ with a flash set signal for flashing the display unit, and also supplies a line $l_{411}$ with the flash set signal. As a result, a signal which becomes the high level at the flash operation is delivered to a line $L_{180}$. The signal of the line $l_{180}$ is fed to the display digit control ROM in FIG. 15.

An alarm coincidence detection-control signal is delivered to a line $l_{414}$ from the display flag control ROM, while an alarm coincidence detention inhibit-control signal is delivered to a line $l_{415}$.

Flip-flop circuits $FD_{67}$–$FD_{72}$ are supplied with control signals for controlling the digits of label, second, minute, hour, week and month in the display unit, respectively. Although this is not essential, flip-flop circuits $FD_{73}$–$FD_{75}$ which receive outputs of the flip-flop circuits $FD_{67}$–$FD_{69}$ are disposed so as to provide signals one clock time before from these flip-flop circuits $FD_{73}$–$FD_{75}$.

As shown in FIG. 12, the outputs of the flip-flop circuits $FD_{67}$–$FD_{75}$ are applied to four NAND circuits. In consequence, display digit control signals for controlling the display digits of the display unit are applied to lines $l_{183}$–$l_{186}$. The display digit control signals of the lines $l_{183}$–$l_{186}$ are supplied to the display digit control ROM in FIG. 15.

The internal state control ROM in FIG. 13 is composed of a ROM $\mathbf{13}_{CA}$ which has input lines similar to those of the ROM's in FIGS. 11 and 12, and a ROM $\mathbf{13}_{CB}$ which receives outputs of the ROM $\mathbf{13}_{CA}$ through lines $l_{187}$–$l_{266}$.

Figure 14:
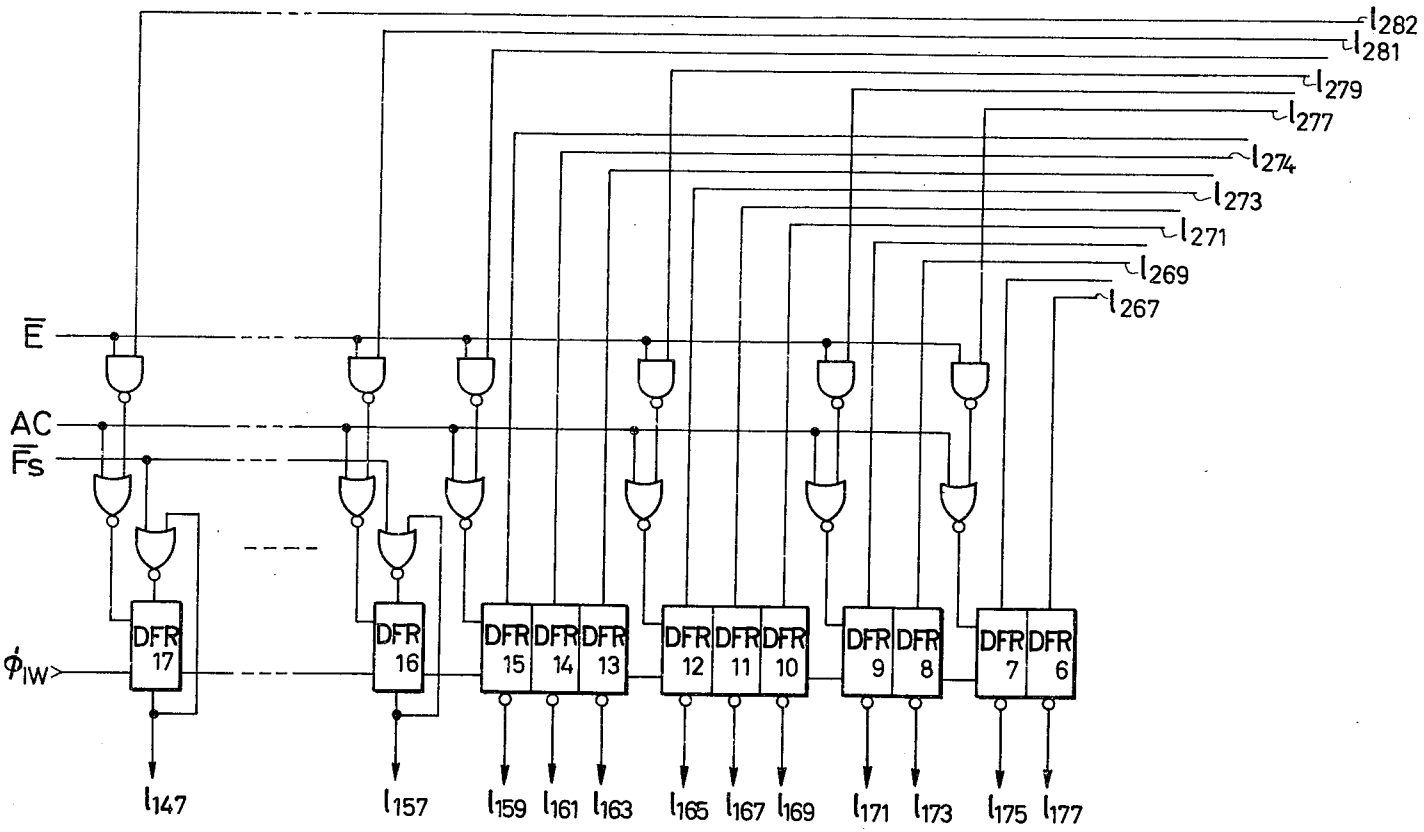

The state storage signals for the internal state storage circuit in FIG. 14 are delivered from the ROM $\mathbf{13}_{CB}$ to lines $l_{267}$–$l_{282}$.

As seen from FIG. 14, the internal state storage circuit is constructed of flip-flop circuits $DFR_6$–$DFR_{17}$, a plurality of NOR circuits and a plurality of AND circuits.

The clock signal is applied to one-side input terminals of the NAND circuits, while the signals from the internal state control ROM $13_{CB}$ in FIG. 13 are applied to the other-side input terminals through the lines $l_{277}$–$l_{282}$. The signals of the lines $l_{277}$–$l_{282}$ are regarded as reset signals of the corresponding flip-flop circuits $DFR_6$–$DFR_{17}$.

Input signals for the flip-flop circuits $DFR_6$–$DFR_{15}$ are applied to the lines $l_{267}$–$l_{275}$.

The flip-flop circuits $DFR_{16}$–$DFR_{17}$ have NOR circuits between the respective inputs and outputs, the NOR circuits being controlled by the clock signal $\overline{F_s}$. Accordingly, the flip-flop circuits $DFR_{16}$–$DFR_{17}$ operate as binary counters which invert their output signals in synchronism with the clock signal $\phi_{1W}$. The flip-flop circuits $DFR_6$–$DFR_{17}$ are reset by the low level of an auto-clear signal AC.

The output signals of the flip-flop circuits $DFR_6$–$DFR_{17}$ are supplied to the internal state control ROM $13_{CA}$ in FIG. 13 through lines $l_{177}$–$l_{147}$.

Figure 15:
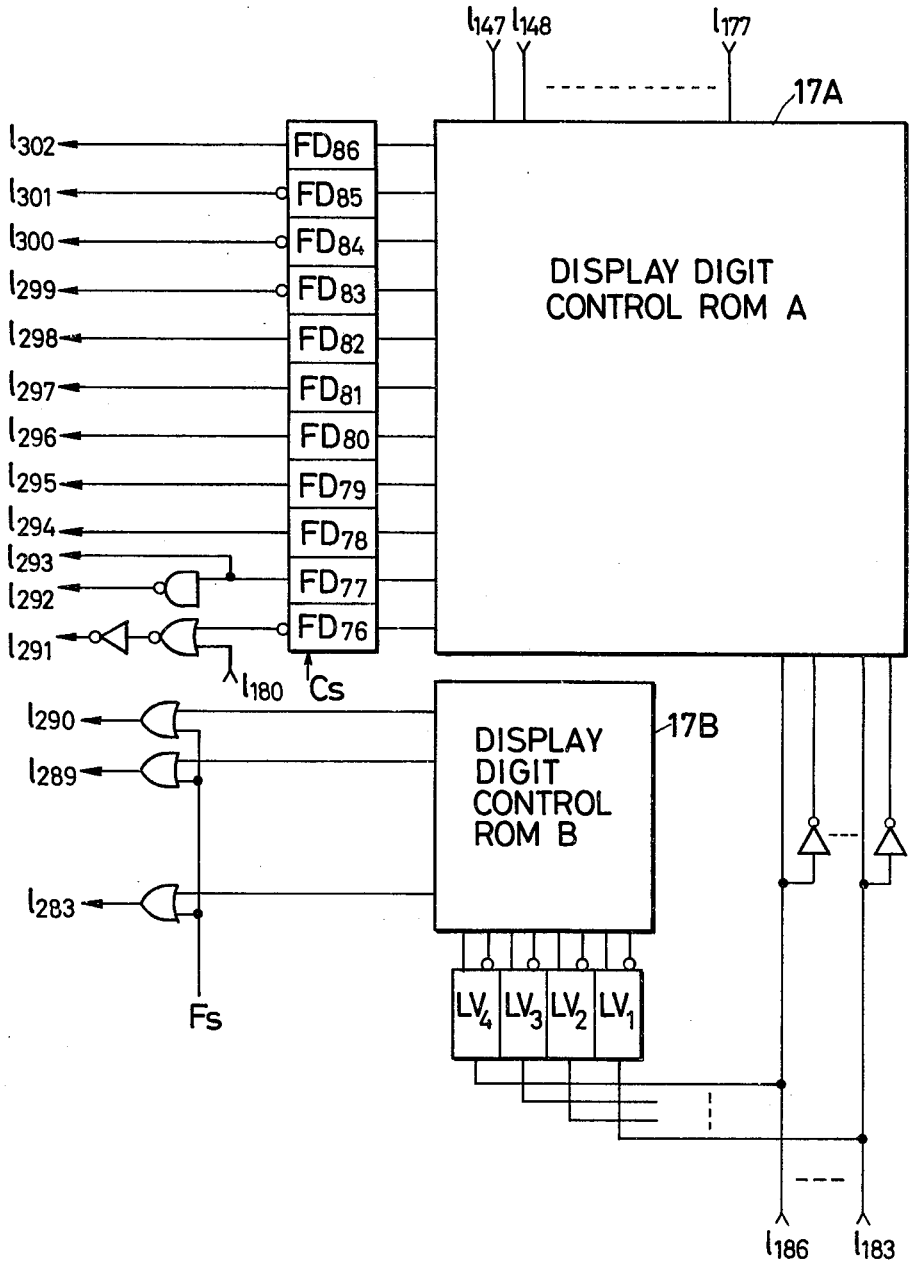
FIG. 15 is a detailed logical circuit diagram of a display digit control circuit (block 17) in FIG. 1.

The display digit control ROM in FIG. 15 is composed of a ROM 17A and a ROM 17B.

The ROM 17A receives at the input lines $l_{147}$–$l_{177}$ the output signals from the flip-flop circuits $DFR_6$–$DFR_{17}$ in FIG. 14, and receives at input lines $l_{183}$–$l_{186}$ the output signals from the display flag ROM in FIG. 12.

This ROM 17A decodes the kinds of data which are to be displayed at the respective timings of the internal state storage circuit. The decoded data are applied to flip-flop circuits $FD_{76}$–$FD_{86}$.

Although this is not especially restrictive, e.g. the flip-flop circuit $FD_{76}$ receives a control signal for flashing display data, and the flip-flop circuit $FD_{77}$ receives a control signal for displaying the time data of hour. Likewise, the flip-flop circuits $FD_{78}$–$FD_{86}$ are respectively supplied with week, AM/PM, label, a special symbol such as arrow, colon, zero mask, zero mask, the upper digit display in the case where binary data which includes a decimal number of at least "10" is indicated in the decimal system, and a control signal for the ten-day digit display.

Figure 16:
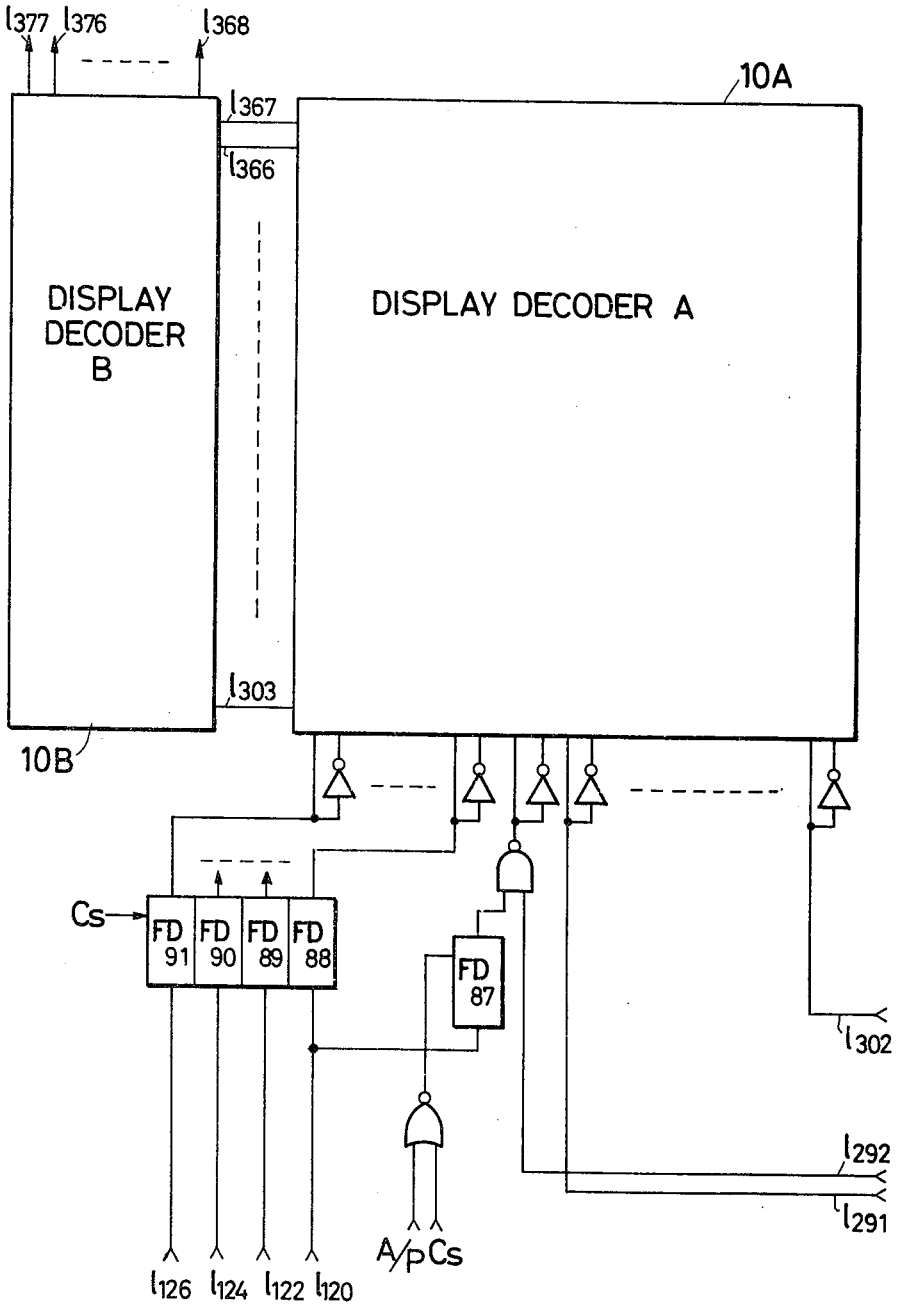
FIG. 16 is a detailed logical circuit diagram of a display decoder (block 10) in FIG. 1.

The control signals of the flip-flop circuits $FD_{76}$–$FD_{86}$ are supplied to the display decoder in FIG. 16 through lines $l_{291}$–$l_{302}$, respectively.

The ROM 17B receive the display digit control signals of the lines $l_{186}$–$l_{183}$ through level shift circuits $LV_1$–$LV_4$, respectively. This ROM 17B delivers digit select signals for the display unit to lines $l_{283}$–$l_{290}$.

The display decoder in FIG. 16 is made up of ROMs 10A and 10B.

The ROM 10A receives binary signals to be displayed, from flip-flop circuits $FD_{88}$–$FD_{91}$, and receives control signals from the display digit control ROM in FIG. 15 and through lines $l_{291}$–$l_{302}$. Depending on the display unit employed, a control signal for the display of the 12-hour system or the display of the 24-hour system is received from outside the circuit.

In case where a binary signal which corresponds to two digits in the decimal system, for example, "12" among hour data "0" to "12", is applied to the flip-flop circuits $FD_{88}$–$FD_{91}$, this ROM 10A supplies lines $l_{303}$–$l_{367}$ with a decode signal corresponding to the decimal "1" in the upper digit when the upper digit display-control signal applied to the line $l_{301}$, and it supplies the lines with a decode signal corresponding to the decimal "2" in the lower digit when the upper digit control signal is "0". Likewise, the binary signal of the flip-flop circuits $FD_{88}$–$FD_{91}$ is decoded as, e.g., week data by the control signals of the lines $l_{291}$–$l_{292}$. When the control signals of the lines $l_{291}$–$l_{302}$ and the binary signal are used in this manner, the display of many data becomes possible with the binary signal of a small number of bits. The capacity of the RAM in FIG. 10 for supplying the binary signal to the lines $l_{120}$–$l_{126}$ may be small.

The ROM 10B receives the decode signal of the lines $l_{303}$–$l_{367}$, and supplies lines $l_{368}$–$l_{377}$ with signals for driving the segments of the respective display digits of the display unit.

The display unit is driven on the basis of the digit select signal delivered from the circuit of FIG. 15 to the lines $l_{283}$–$l_{290}$ and the sgement select signal delivered from the circuit of FIG. 16 to the lines $l_{368}$–$l_{377}$.

This invention is not restricted to the foregoing embodiment, but it can adopt various aspects of performance.

In the PLA system according to this invention, the number of program steps is not restricted to 40. However, use of a ring counter of 40 counts which is driven by 4 kHz is very convenient for clock operations in such a manner that one circulation becomes 0.01 second in the stop watch function.

What is claimed is:

1. An electronic multifunction timepiece including a key input circuit, a clock pulse generator circuit, a random access memory which stores time data therein, an adder circuit, a read only memory which stores therein control instructions for controlling operations of said random access memory and said adder circuit and for causing said random access memory to write renewed time data and which provides the control signals sequentially on the basis of clock pulses of said clock pulse generator circuit, and a display means for displaying said time data, characterized in that said read only memory comprises a first read only memory which stores therein control signals for renewing the time data of said random access memory independently of operation modes appointed by said key input circuit, and a second read only memory which stores therein control instructions for controlling information processing operations in the operation modes appointed from said key input circuit.

2. An electronic multifunction timepiece as defined in claim 1, characterized by comprising a display digit-controlling read only memory which receives an output of said second read only memory, and a display decoder which receives an output of said display digit-controlling read only memory and an output of said random access memory and which provides a signal for driving a display unit.

3. An electronic multifunction timepiece including a key input circuit, a clock pulse generator circuit, a random access memory which stores time data therein, an adder circuit, a read only memory which stores therein control instructions for controlling operations of said adder circuit and for causing said random access memory to write renewed time data and which provides the control signals sequentially on the basis of clock pulses of said clock pulse generator circuit, and a display means for displaying said time data, characterized by further comprising a page control circuit, said read only memory being of a page construction and receiving a signal from said page control circuit.

4. An electronic multifunction timepiece as defined in claim 3, characterized in that an output signal of said key input circuit has the same number of bits as the output of said page control circuit and is applied to said page control circuit as an input thereof.

5. In an electronic multifunction timepiece having an input circuit means, a clock means, a display means, a first memory means for storing time data therein, a read only memory which stores therein control instructions for controlling operations of said first memory means and for causing said first memory means to write renewed time data and which provides control signals sequentially on the basis of the output of said clock means, and a display means for displaying said time data, the improvement comprising said read only memory comprising a first read only memory which stores therein control signals for renewing the time data of said first memory means independently of operation modes appointed by said input means, and a second read only memory which stores therein control instructions for controlling information processing operations in the operation mode appointed from said input circuit means.

6. An improved electronic multifunction timepiece as defined in claim 5, wherein said input circuit means comprises a key input circuit.

7. An improved electronic multifunction timepiece as defined in claim 6, wherein said first memory means which stores time data therein comprises a random access memory.

8. An improved electronic multifunction timepiece as defined in claim 7, comprising a display digit-controlling read only memory which receives an output of said second read only memory, and a display decoder which receives an output of said display digit-controlling read only memory and an output of said random access memory and which provides a signal for driving a display unit.

9. An electronic multifunction timepiece comprising:

a random access memory for storing time data at plural addresses thereof;

an adder circuit for receiving a selected time data of said random access memory and delivering a renewed time data for the selected time data, said renewed time data being written in said random access memory;

a control pulse generator circuit for generating a binary coded control signal;

a first read only memory which stores control signals at plural addresses thereof for renewing the time data of said random access memory, said first read only memory delivering an address signal being applied to said random access memory, a first adder control signal controlling said adder circuit and a first renewing control signal causing the renewed time data of said adder circuit to write in said random access memory under receipt of said binary coded control signal of the control pulse generator circuit;

a key input circuit for designating operation modes, said key input circuit generating a key input signal corresponding to selected one of said operation modes;

an internal state memory including a memory for storing said operation modes of the key input circuit and for delivering a control signal corresponding to said operation modes;

a second read only memory which stores control instructions for controlling operations of said random access memory and adder circuit in accordance with the operation modes designated by said key input circuit, said second read only memory receiving said key input signal, said binary coded control signal of the control pulse generator circuit and said control signal of the internal state memory, and delivering a second adder control signal controlling said adder circuit and a second renewing control signal controlling the time data to be written in said random access memory; and a display decoder circuit for converting the time data stored in said random access memory into a display signal to be displayed.

10. An electronic multifunction timepiece according to claim 9, further including a display digit-controlling read only memory which stores control signals for driving said display decoder circuit, said display digit-controlling read only memory receiving a control signal of the second read only memory, and delivering a display control signal controlling the display decoder circuit under receipt of the control signal of the second read only memory.

11. An electronic multifunction timepiece comprising:

a random access memory for storing time data at plural addresses;

an adder circuit for receiving a selected time data of said random access memory and delivering a renewed time data for the selected time data, said renewed time data being written in said random access memory;

a discrimination circuit for receiving the time data delivered from said adder circuit and detecting the received time data to have changed into a predetermined data;

a page control circuit for receiving the output signal of said discrimination circuit and delivering a page control signal;

a control pulse generator circuit for generating a control signal;

a first read only memory for receiving the control signal of said control pulse generator circuit and the page control signal of said page control circuit, and for delivering an address signal designating the address of said random access memory in accordance with a combination of said control signal and said page control signal, an address signal controlling operation of said adder circuit, a discrimination control signal controlling operation of said discrimination circuit and a control signal controlling operation of said page control circuit so as to derive another page control signal from said page control circuit;

a key input circuit for designating operation modes, said key input circuit generating a key input signal corresponding to selected one of said operation modes;

an internal state memory for storing an internal state of the timepiece, and for delivering a control signal corresponding to the internal state;

a second read only memory for receiving said key input signal, the control signal of said control pulse generator circuit, the page control signal of said page control circuit and the control signal of said internal state memory, and for delivering a data signal to be written in said internal state memory a control signal controlling operation of said adder circuit and a control signal controlling the time data to be written in said random access memory; and a display decoder circuit for converting the time data stored in said random access memory into a display signal to be displayed.

12. An electronic multifunction timepiece as defined in claim 11, wherein the key input signal and page control signal are formed of binary coded signals of same bits, respectively, and said key input signal is applied to said second read only memory through said page control circuit.

* * * * *